US011759928B2

(12) United States Patent
Kuriki et al.

(10) Patent No.: US 11,759,928 B2
(45) Date of Patent: Sep. 19, 2023

(54) DRIVING TOOL

(71) Applicant: MAKITA CORPORATION, Anjo (JP)

(72) Inventors: Shun Kuriki, Anjo (JP); Norikazu Baba, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/725,757

(22) Filed: Apr. 21, 2022

(65) Prior Publication Data

US 2022/0371169 A1 Nov. 24, 2022

(30) Foreign Application Priority Data

May 20, 2021 (JP) ..... 2021-085133
Oct. 12, 2021 (JP) ..... 2021-167485

(51) Int. Cl.
*B25C 1/04* (2006.01)
*B25C 1/00* (2006.01)

(52) U.S. Cl.
CPC ..... *B25C 1/047* (2013.01); *B25C 1/008* (2013.01)

(58) Field of Classification Search
CPC ..... B25C 1/041; B25C 1/047; B25C 1/04; B25C 1/06; B25C 1/008
USPC ..... 227/130
See application file for complete search history.

(56) References Cited

U.S. PATENT DOCUMENTS

2018/0126528 A1* 5/2018 Pomeroy ..... B25C 1/06
2018/0154505 A1 6/2018 Sato et al.
2021/0031347 A1 2/2021 Sato et al.
2021/0308852 A1* 10/2021 Ueda ..... B25C 1/047

FOREIGN PATENT DOCUMENTS

WO WO2016/199670 A1 3/2018
WO 2020/059666 A1 3/2020

* cited by examiner

*Primary Examiner* — Daniel Jeremy Leeds
*Assistant Examiner* — Veronica Martin
(74) *Attorney, Agent, or Firm* — Oliff PLC

(57) ABSTRACT

A driving tool comprises a displacement allowing mechanism that allows a wheel to be displaced in a radial direction of a rotation shaft. The driving tool further comprises a displacement restricting mechanism that restricts the wheel from being displaced in the radial direction of the rotation shaft. When a driver is to start being moved upwards by an engagement of a first engagement portion with an engaged portion by rotation of the wheel, a displacement restriction state of the wheel caused by the displacement restricting mechanism is released, allowing an entirety of the wheel to be displaceable in the radial direction of the rotation shaft due to the displacement allowing mechanism.

20 Claims, 22 Drawing Sheets

DRIVING TOOL

CROSS-REFERENCE TO RELATED APPLICATIONS

This application claims priority to Japanese patent application serial number 2021-085133, filed on May 20, 2021, and to Japanese patent application serial number 2021-167485, filed on Oct. 12, 2021, both the contents of which are incorporated herein by reference in their entirety for all purposes.

BACKGROUND

The present disclosure generally relates to a driving tool for driving a material, such as a nail or a staple, into a workpiece, such as, for example, a wooden material.

For example, a gas-spring type driving tool may utilize a thrust power of compressed air as a driving force, e.g., in International Publication No. 2020/059666 and international Publication No. 2016/199670. The gas-spring type driving tool may include a piston that moves in an up-down direction within a cylinder and a driver that is connected to the piston. The piston may move integrally with the piston in the up-down direction and drive a driving member. The piston and the driver may move downward in a driving direction owing to a pressure of the gas filled in an accumulation chamber. The piston and the driver may return in a direction opposite to the driving direction by a lift mechanism.

The lift mechanism may include a wheel that include a plurality of engagement portions, each of which engages a corresponding engaged portion formed in the driver. The wheel may be rotated by an electric motor. After a driving operation has been completed, each of the plurality of the engagement portions may successively engage a corresponding engaged portion of the driver by rotation of the wheel, thereby moving the driver upward. By the upward movement of the piston in the direction opposite to the driving direction, the gas pressure in the accumulation chamber may increase. When an engagement state of the lift mechanism with respect to the driver, after the driver has reached an upper end position, is released, the driver may move downward owing to the gas pressure, thereby performing a driving operation.

In some situations, a load applied to an engaged portion of the driver or an engagement portion of the lift mechanism may be restricted, e.g., in International Publication No. 2020/059666. For example, an engagement portion (e.g., a final pin) of the lift mechanism that engages a corresponding engaged portion of the driver, for instance at an upper end position of the driver, may be displaced in a direction opposite to the engaging direction, thereby restricting the load. As another example, a countermeasure method may be needed for when a relative position of the engagement portion of the lift mechanism with respect to the corresponding engaged portion of the driver is shifted owing to nail jamming, e.g. in International Publication No. 2016/199670. In more detail, by displacing an engagement portion (e.g., a first pin) of the lift mechanism that firstly engages an engaged portion of the driver when the driver starts moving upward, the engagement portion of the lift mechanism may be prevented from interfering with the engaged portion of the driver.

SUMMARY

In the above-described examples, a part of the plurality of engagement portions of the lift mechanism, e.g., the first pin or the final pin, may be displaceable at all times. Because of this, a configuration of the lift mechanism may be complicated. Also, the durability of the lift mechanism may be decreased, thereby increasing the possibility of an operation failure. Thus, there is a need for another configuration that does not decrease the durability of the lift mechanism while still obtaining a satisfactory operation.

According to one aspect of the present disclosure, a driving tool comprises a piston that moves in a driving direction by a pressure of gas. The driving tool also comprises a driver that drives a driving member by moving integrally with the piston in the driving direction. Furthermore, the driving tool comprises a lift mechanism that moves the driver in a direction opposite to the driving direction. Furthermore, the driver comprises a plurality of engaged portion disposed along a longitudinal direction of the driver. The lift mechanism comprises a rotation shaft, a wheel that rotates integrally with the rotation shaft and rotates around the rotation shaft, and a plurality of engagement portions that are arranged along an outer periphery of the wheel. Each of the plurality of engagement portions is configured to engage a corresponding engaged portion. The lift mechanism further comprises a displacement allowing mechanism that allows the wheel to be displaced in a radial direction of the rotation shaft, and a displacement restricting mechanism that restricts the wheel from being displaced in the radial direction of the rotation shaft. The plurality of engagement portions include a first engagement portion that firstly engages one of the plurality of engaged portions and a second engagement portion that secondly engages one of the plurality of engaged portions when the lift mechanism moves the driver in the direction opposite to the driving direction. At least when the first engagement portion engages one of the plurality of engaged portions, a state in which the wheel is restricted from being displaced in the radial direction of the rotation shaft by the displacement restriction mechanism is released.

Because of this configuration, an interference state of the first engagement portion with respect to the engaged portion of the driver (a state in which the first engagement portion can not engage an appropriate portion of a lower surface of the engaged portion) can be accommodated for by the displacement of the wheel in the radial direction of the rotation shaft. Accordingly, for example, in a case where a nail jam causes the driver to stop moving before reaching a lower end position in the driving direction, and as a result, an interference state occurs such that the first engagement portion of the wheel is unable to engage appropriate portion of the lower surface of the engaged portion, the displacement of the wheel in the radial direction of the rotation shaft can overcome the interference state to cause the engagement portion to engage another one of the engaged portions. After the engagement portion of the wheel appropriately engages one of the engaged portions of the driver, the driver can move upwards by rotation of the wheel.

By the displacement allowing mechanism, an entirety of the wheel is displaced in the radial direction of the rotation shaft to cause the engagement portion of the wheel to be displaced apart from the engaged portion of the driver. In comparison with a configuration in which only a part of the engagement portion is displaced, the mechanism of the above described configuration can be simplified by avoiding complicated components. Furthermore, in the present disclosure, when the interference state occurs to cause the first engagement portion to receive an external force more than a predetermined value in a direction opposite to the engagement direction from the engaged portion of the driver, the wheel is allowed to be displaced in the radial direction of the rotation shaft by the displacement allowing mechanism. The external force caused by the interference of the first engagement portion can be absorbed by the displacement of the wheel in the radial direction of the rotation shaft, thereby allowing the first engagement portion to a more normal engagement state of the first engagement portion. Furthermore, the wheel is restricted from being excessively displaced by the displacement restricting mechanism. Accordingly, in comparison with a configuration in which each engagement portion is allowed to be displaced relative to a wheel, an operation failure can be more reliably avoided.

BRIEF DESCRIPTION OF THE DRAWINGS

FIG. 11 is a state of the engagement potion with respect to an engaged portion being in the locked state. This figure shows that a wheel is displaced in a radial direction of the wheel when the first engagement portion has received an external force equal to or more than a prescribed value from the third engaged portion.

DETAILED DESCRIPTION

Figure 1:
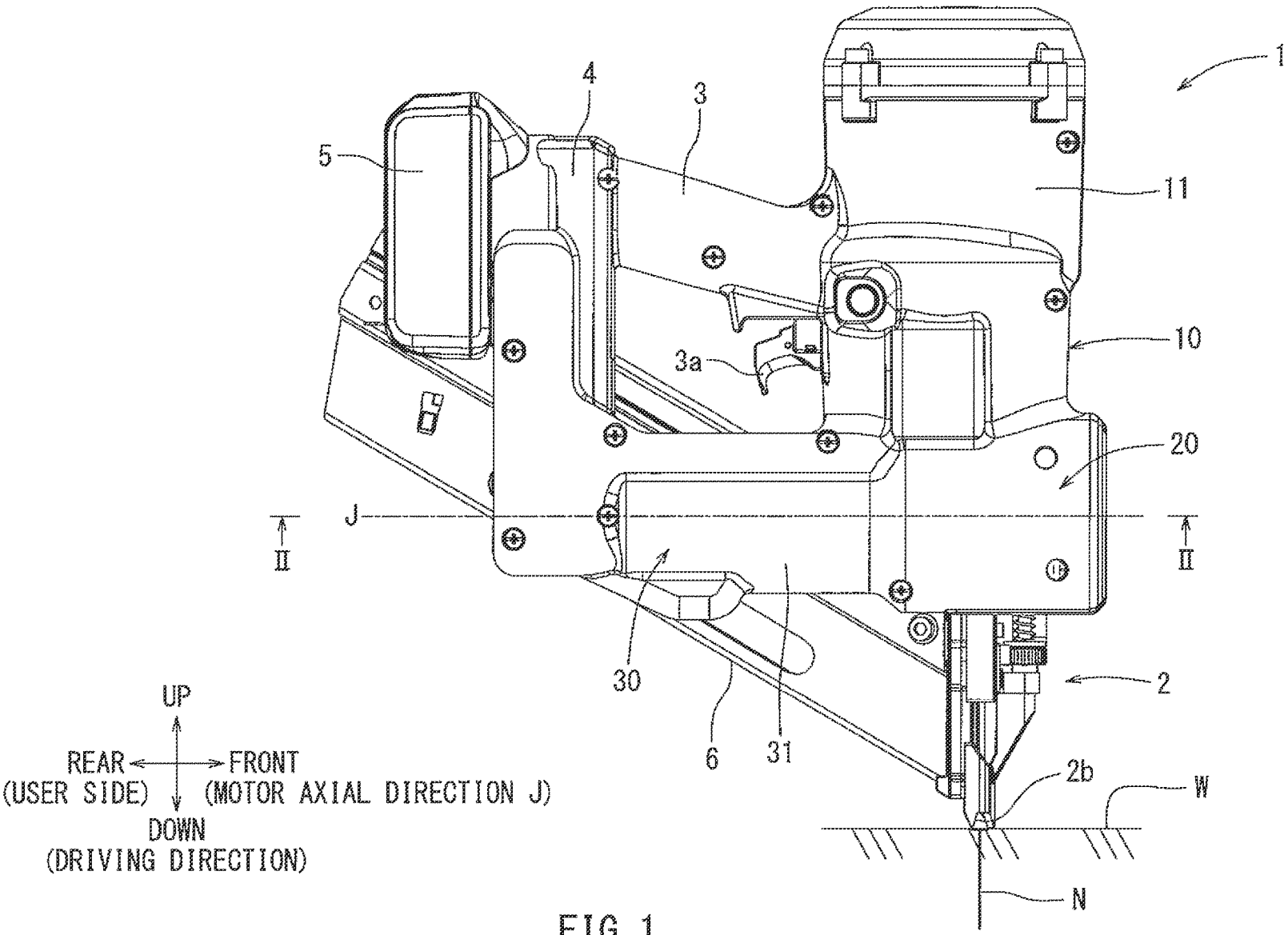
FIG. 1 is an overall side view of a driving tool according to a first embodiment of the present disclosure.

The detailed description set forth below, when considered with the appended drawings, is intended to be a description of exemplary embodiments of the present disclosure and is not intended to be restrictive and/or to represent the only embodiments in which the present disclosure can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the disclosure. It will be apparent to those skilled in the art that the exemplary embodiments of the disclosure may be practiced without these specific details. In some instances, these specific details refer to well-known structures, components, and/or devices that are shown in block diagram form in order to avoid obscuring significant aspects of the exemplary embodiments presented herein.

According to one aspect of the present disclosure, when a second engagement portion engages one of a plurality of engaged portions, a wheel is restricted from being displaced in a radial direction of a rotation shaft by a displacement restricting mechanism.

Because of this configuration, the wheel is allowed to be displaced in the radial direction of the rotation shaft only when a first engagement portion engages the engaged portion of the driver. It may be considered that an abnormal engagement state may typically occur when the first engagement portion engages the engaged portion of the driver. In contrast, when any of the engagement portions other than the first engagement portion engages the engaged portions, the wheel is not allowed to be displaced, thereby reliably avoiding an operation failure.

According to one aspect of the present disclosure, at least when a direction in which a force is applied to the wheel is parallel to the driving direction, the wheel is restricted from being displaced in the radial direction of the rotation shaft.

When a direction in which the engagement portion of the wheel receives an external force from the driver (e.g., in a direction in which the driver moves) is parallel to the driving direction, the engagement portion of the wheel receives a large external force (e.g., corresponding to a thrust force of the pressure of gas in the accumulation chamber) from the driver. In this stage, at the latest, the wheel is restricted from being displaced by the displacement restricting mechanism. Accordingly, an engagement state of the lift mechanism with regard to the driver can be properly retained, thereby reliably avoiding an operation failure. When a direction in which the wheel is allowed to be displaced non-parallel with regard to a direction in which the driver moves, an external force from the driver in the driving direction becomes smaller. In a stage, at the latest, when a direction in which the engagement portion of the wheel receives an external force from the driver (e.g., in a direction other than the direction in which the driver moves) is parallel to a direction in which the wheel is allowed to be displaced, the wheel is allowed to be displaced. Accordingly, an engagement state can be reliably retained while a large external force is applied to the engagement portion.

According to one aspect of the present disclosure, the displacement allowing mechanism includes an insertion hole formed in the wheel. The insertion hole is formed in an oblong hole shape in the radial direction of the wheel, such that the wheel is allowed to be displaced in the radial direction of the rotation shaft. Furthermore, the displacement restricting mechanism includes a lock member that restricts the wheel from being displaced in the radial direction of the rotation shaft by insertion of the lock member into the insertion hole.

Because of this configuration, the wheels restricted from being displaced in the radial direction of the rotation shaft by the lock member, in part due to the lock member being inserted between the insertion hole of the wheel and the rotation shaft supporting the wheel. When the lock member retracts from the insertion hole, the wheel is allowed to be displaced in the radial direction of the rotation shaft. The advancing/retracting movement of the lock member into/from the insertion hole allows for the switching between a state in which the wheel is restricted from being displaced and a state in which the wheel is allowed to be displaced.

According to one aspect of the present disclosure, the lock member is configured to advance into the insertion hole and retract from the insertion hole in an axial direction of the rotation shaft. Accordingly, the advancing/retracting movement of the lock member into/from the insertion hole can be performed by a simple configuration.

According to one aspect of the present disclosure, the lock member is disposed on an inner periphery side than the plurality of engagement portions. Accordingly, the displacement restricting mechanism can be made more compact.

According to one aspect of the present disclosure, the displacement restricting mechanism includes a cam mechanism by which the lock member may advance into the insertion hole and retract from the insertion hole based on the rotational position of the wheel. Accordingly, the lock member may advance into and retract from the insertion hole in an interlocking manner with the rotation of the wheel.

According to one aspect of the present disclosure, the insertion hole includes a pair of slide surfaces on an inner wall surface of the insertion hole. Each of the pair of slide surfaces is parallel to one another and extends in a radial direction of the wheel. Furthermore, the rotation shaft includes a pair of supporting surfaces extending in the radial direction of the rotation shaft on an outer peripheral surface of the rotation shaft. Each of the pair of supporting surfaces is configured to face a corresponding slide surface of the insertion hole. Accordingly, by slidably contacting the slide surfaces of the insertion holes with supporting surfaces of the rotation shaft, rotation of the rotation power is transferred to the wheel, thereby causing the wheel to rotate integrally with the rotation shaft. This also allows the wheel to be supported by the rotation shaft so as to be displaced in the radial direction of the rotation shaft.

According to one aspect of the present disclosure, a biasing member is inserted into the insertion hole. The biasing member is configured to bias the wheel in a direction in which one of the plurality of engagement portions of the wheel engages a corresponding engaged portion of the driver. Accordingly, an engagement state of the engagement portions with the engaged portions can be retained by the biasing member. Furthermore, the displacement allowing mechanism can be made more compact by inserting the biasing member into the insertion hole.

According to one aspect of the present disclosure, the displacement restricting mechanism includes a biasing member configured to bias the lock member in a direction in which it can retract from the insertion hole. Accordingly, the lock member can reliably retract from the insertion hole by a simple configuration.

According to one aspect to the present disclosure, the cam mechanism includes a plurality of cams. The cams may be arranged at unequal intervals around an axis of the rotation shaft. The lock member completely retracts from the insertion hole when all of the plurality of cams engage each other at a predetermined position around the axis of the rotation shaft. Accordingly, a state in which the wheel is restricted from being displaced in the radial direction of the rotation shaft is reliably transferred to a state in which the wheel is allowed to be displaced in the radial direction of the rotation shaft. This may occur at the predetermined position around the axis of the rotation shaft. Because of this configuration, an engagement state of the lift mechanism with respect to the driver can be properly and reliably retained.

According to one aspect of the present disclosure, the displacement allowing mechanism includes an insertion hole formed in the wheel. The insertion hole is formed in an oblong hole shape in the radial direction of the wheel. As such, the wheel is allowed to be displaced in the radial direction of the rotation shaft. Furthermore, the displacement restricting mechanism comprises a restriction member formed in the wheel. The displacement restricting mechanism also comprises a restriction wall that is formed along a periphery of the wheel. The restriction wall is configured to restrict the restriction member from being displaced in the radial direction of the rotation shaft. The displacement restricting mechanism further comprises a restriction release portion that releases a restricting state of the restriction member caused by the restriction wall.

Because of this configuration, the wheel is restricted from being displaced in the radial direction of the rotation shaft. This is accomplished at least in part due to the restriction wall restricting the restriction member from being displaced in the radial direction of the rotation shaft. When the restriction member runs off the restriction wall, the wheel is allowed to be displaced in the radial direction of the rotation shaft. A state in which the wheel is allowed to be displaced in the radial direction of the rotation shaft can be transferred to a state in which the wheel is restricted from being displaced in the radial direction of the rotation shaft, and vice versa. This may be allowed at least in part due to the restriction wall being displaced in the radial direction of the rotation shaft, which restricts the restriction member from being displaced in the radial direction of the rotation shaft.

According to one aspect of the present disclosure, the restriction member protrudes from each surface of the wheel in an axial direction of the wheel. Accordingly, the restriction member is led by the restriction wall on each side thereof in the axial direction of the wheel. Because of this configuration, the wheel rotates in a stable manner. Additionally, the wheel is in a state in which the wheel is restricted from being displaced in the radial direction of the rotation shaft. Accordingly, the wheel can be reliably transferred to a state in which the wheel is allowed to be displaced in the radial direction of the rotation shaft, and vice versa.

According to one aspect of the present disclosure, an end portion of each one of the plurality of engagement portions protrudes from a corresponding surface of the wheel. The restriction member is formed by use of the end portion of the one of the plurality of engagement portions. Accordingly, a configuration of the restriction member can be made more simple, because the restriction member is formed by use of the engagement portion.

According to one aspect of the present disclosure, the restriction member is arranged in a position opposite to the first engagement portion, with regard to the rotation shaft. Accordingly, a direction in which the wheel is allowed to be displaced is configured to be a direction in which the first engagement portion moves away from the engaged portions of the driver. Because of this configuration, when the first engagement portion inappropriately engages the engaged portion, the wheel is allowed to be displaced in the radial direction of the rotation shaft, thereby accommodating for an interference between the first engagement portion and the engaged portion, if an inappropriate engagement occurs.

According to one aspect of the present disclosure, the restriction member includes a rotatable roller around its axis. Accordingly, the restriction member can smoothly move along the restriction wall, thereby causing the wheel to rotate in a stable and smooth manner.

FIG. 1 shows an example of a driving tool 1, e.g., a gas-spring type driving tool that utilizes a pressure of a gas filled in an upper chamber of a cylinder as a thrust power for driving a driving member N. In the following explanation, a driving direction of the driving member N is a downward direction, and a direction opposite to the driving direction is an upward direction. As discussed later, when a driver 15 moves downward, the driving member N may be driven. After the driving operation has been completed, the driver 15 may be returned upward. In FIG. 1, a user of the driving tool 1 may be generally situated on a rear side of the driving tool 1. The rear side of the driving tool 1 may also be referred to as a user side, and a side in a forward direction may be referred to as a front side. Also, a left and right side may be based on a user's position.

Figure 2:
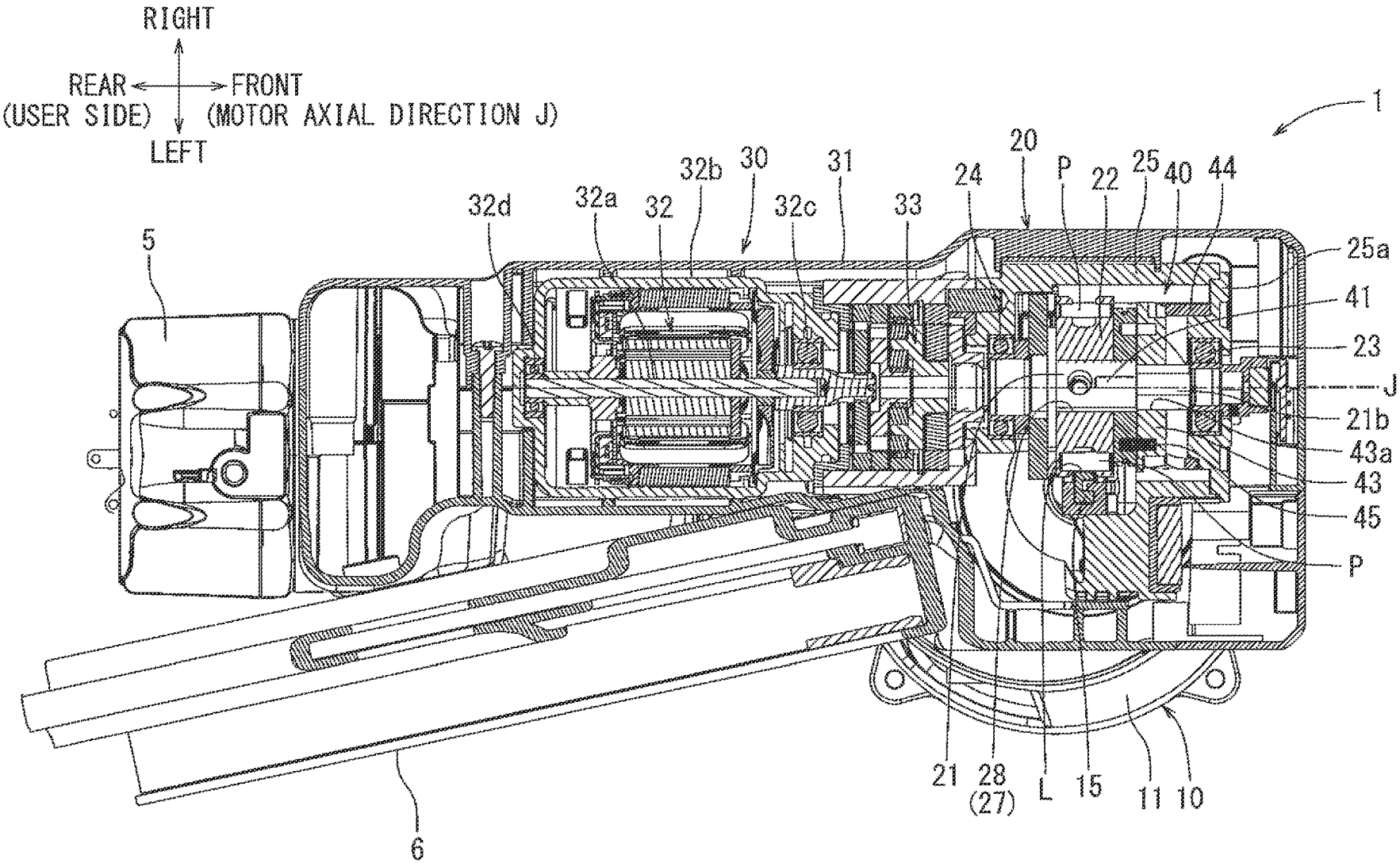
FIG. 2 is a cross-sectional view taken along line II-II of FIG. 1.
Figure 3:
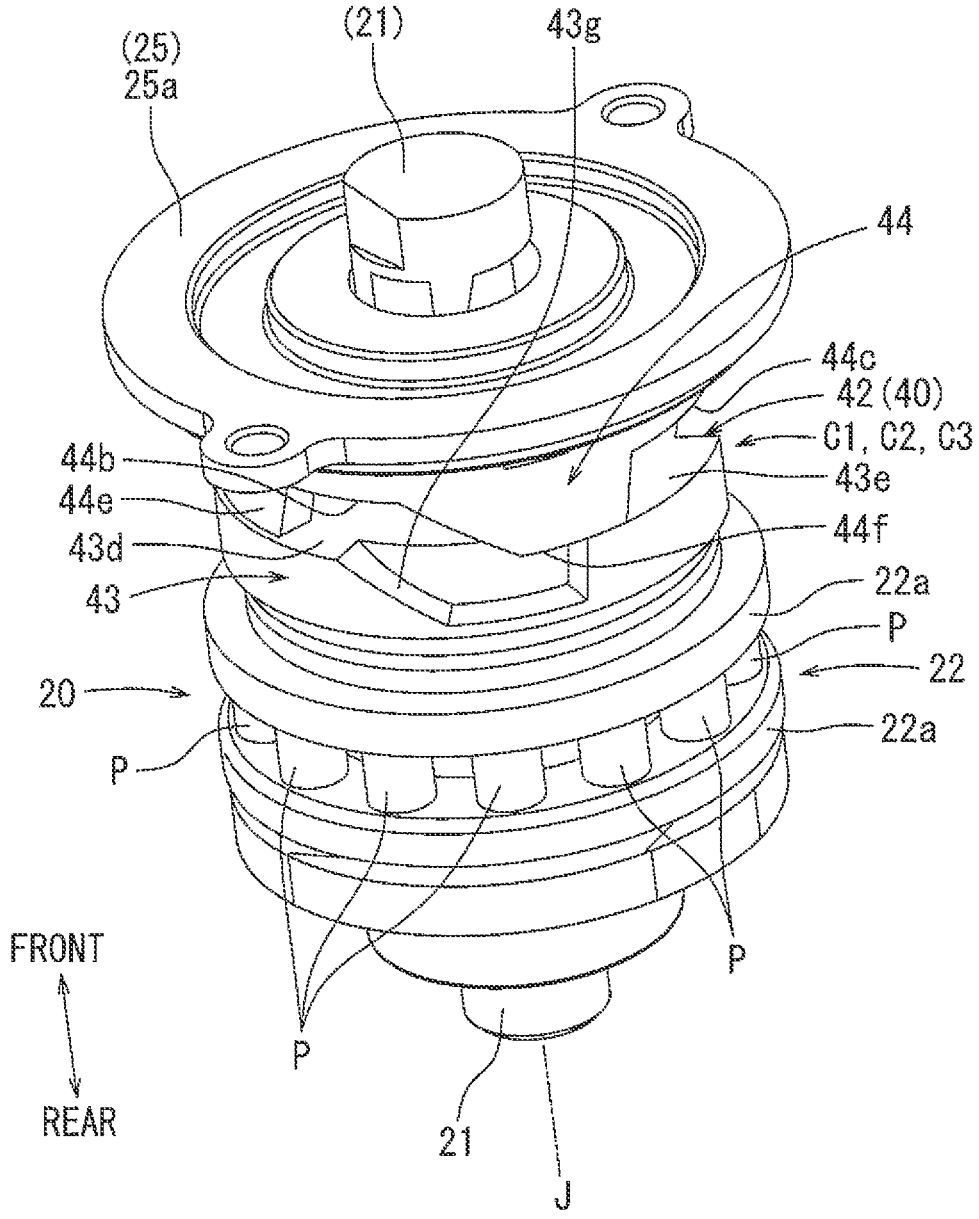
FIG. 3 is a perspective view of a lift mechanism and a displacement allowing mechanism according to the first embodiment.
Figure 9:
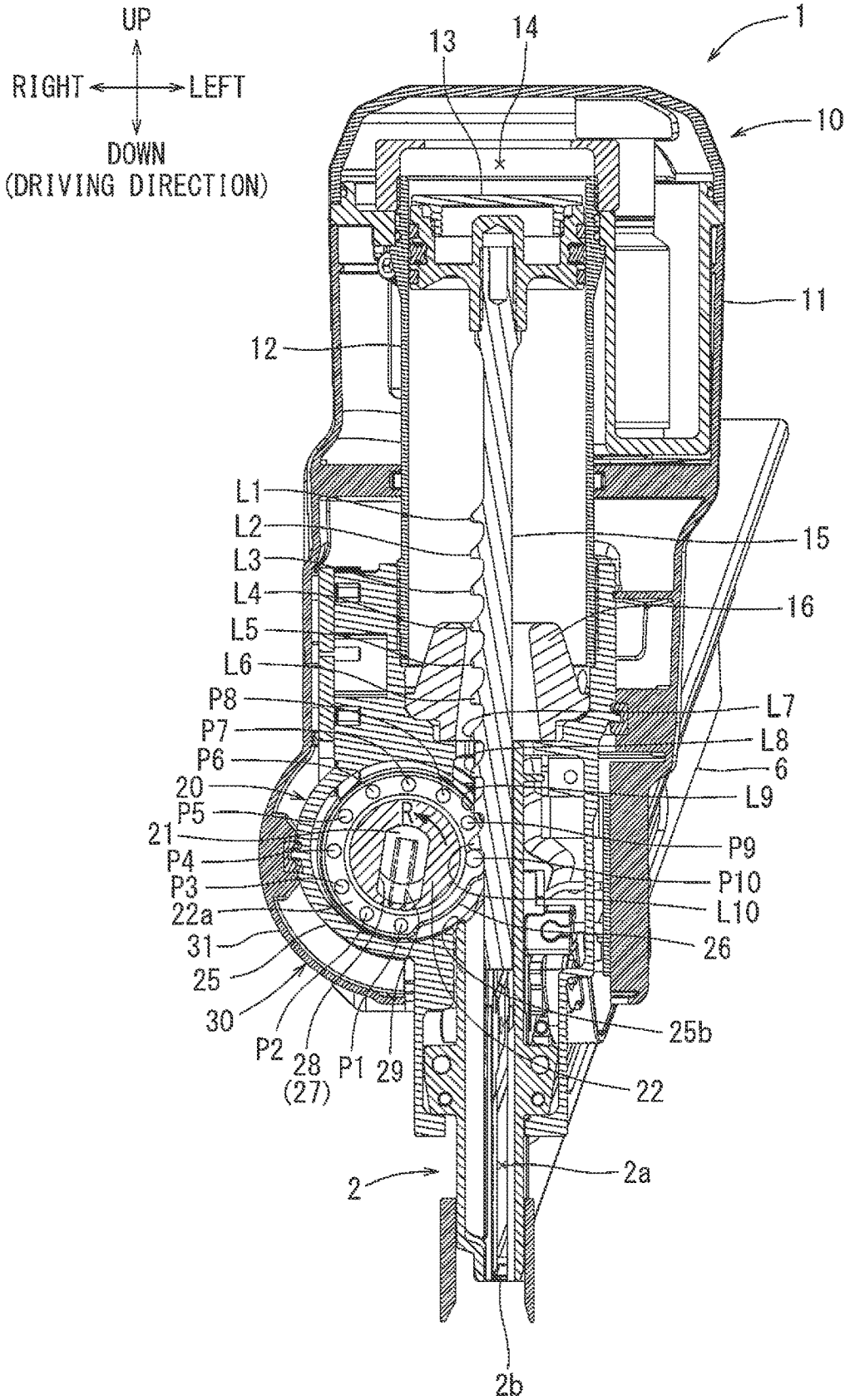
FIG. 9 is a longitudinal cross-sectional view of a tool main body of the driving tool, showing that the tool main body is in a standby state.

As shown in FIGS. 1, 2, and 9, the driving tool 1 may include a tool main body 10. The tool main body 10 may be configured to include a cylinder 12 that is housed in a tubular main body housing 11. A piston 13 may be housed within the cylinder 12, so as to be able to be reciprocated in an up-down direction. An upper portion of the cylinder 12 may communicate with an accumulation chamber 14. A pressure of a gas filled in the accumulation chamber 14 may act on an upper surface of the piston 13, thereby providing a thrust power for a driving operation.

A driver 15 may be connected to a lower surface of the piston 13. The driver 15 may extend long and downward. A lower portion of the driver 15 may enter a driving passage 2*a* of a driving nose 2, the driving nose 2 being formed at a lower portion of the tool main body 10. Owing to the pressure of the gas filled in the accumulation chamber 14, which is configured to act on the upper surface of the piston 13, the driver 15 may move downward within the driving passage 2*a*, thereby being capable of driving a driving member N. The driving member N that is driven by the driver 15 may be driven into a workpiece W. A lower end damper 16 for absorbing an impact that the piston 13 receives may be disposed on a lower side of the cylinder 12.

A grip 3, which is configured to be held by a user, may be formed on a lateral side of the tool main body 10. A switch lever 3*a*, which is configured to be pulled by a fingertip of the user, may be formed on a lower surface on the front side of the grip 3. A battery attachment portion 4 may be formed on a rear side of the grip 3. A battery pack 5 may be attached to the battery attachment portion 4. A driving unit 30, which is discussed in greater detail later, may be operated by power supplied from the battery pack 5. The battery pack 5 may serve as a power source for the driving unit 30.

A magazine 6 may be combined with the driving nose 2. A plurality of driving members N, which are loaded within the magazine 6, may be supplied to the driving passage 2*a*, one by one.

A lift mechanism 20 may be linked to a lateral portion of the driving nose 2. The lift mechanism 20 may have a function of returning the driver 15, and accordingly the piston 13, upward after a driving operation has been completed. The pressure of the gas in the accumulation chamber 14 may increase owing to an upward movement of the piston 13 by the lift mechanism 20.

The lift mechanism 20 may be arranged so that it may be operated by the driving unit 30. The driving unit 30 may be housed in a nearly L-shaped driving unit case 31 that straddles an area including the lift mechanism 20 and a lower portion of the battery attachment portion 4. The driving unit case 31 may be formed integrally with the main body housing 11. The lift mechanism 20 may be covered by the driving unit case 31.

As shown in FIG. 2, the driving unit 30 may include an electric motor 32. The electric motor 32 may serve as a driving source of the driving unit 30. The electric motor 32 may be housed in the driving unit 30, such that an axis line (e.g., a motor axis line J) of an output shaft 32*a* of the electric motor 32 is disposed in a front-rear direction and perpendicular to the driving direction. In FIG. 2, the driving direction may be a direction perpendicular to a paper surface of FIG. 2. The electric motor 32 may be operated by power supplied from the battery pack 5. The battery pack 5 may serve as a power source for the electric motor 32. The electric motor 32 may be activated by a pull operation of the switch lever 3*a* or any other suitable operation.

As shown in FIG. 2, the output shaft 32*a* of the electric motor 32 may be rotatably supported by a motor housing 32*b*, via bearings 32*c*, 32*d*. The output shaft 32*a* may be connected to a reduction gear train 33. A tubular lift mechanism case 25 may be combined with a front portion of the motor housing 32*b*. The reduction gear train 33 may be supported on an inner periphery side of the lift mechanism case 25. A first planet gear to a third planet gear may be used for the reduction gear train 33. The first to third planet gears may be disposed coaxial to each other, and may be disposed coaxial with the motor axis line J. A rotation output of the electric motor 32 may be output to the lift mechanism 20, for instance after being reduced by the reduction gear train 33, which may include the first to third planet gears.

The lift mechanism 20 may include a rotation shaft 21 that is connected to the reduction gear train 33. The lift mechanism 20 may also include a wheel 22 that is supported by the rotation shaft 21. The rotation shaft 21 may be rotatably supported on the inner periphery side of the lift mechanism case 25, for instance via a front bearing 23 and a rear bearing 24. A rotation axis line of the rotation shaft 21 may be aligned with the motor axis line J. A displacement restricting mechanism 40 may be connected to a front side of the lift mechanism 20. A front portion of the lift mechanism case 25, which is disposed on a front side of the displacement restricting mechanism 40, may be covered with a cover 25*a*. The front bearing 23 may be held by the cover 25*a* of the lift mechanism case 25. The rear bearing 24 may be held by a rear portion of the lift mechanism case 25.

The electric motor 32 may rotate the wheel 22 of the lift mechanism 20. As shown in FIGS. 2-5, the wheel 22 may include two flanges 22*a*. The flanges 22*a* may be parallel to each other and spaced apart by a predetermined distance. A plurality of engagement portions P may be disposed between the two flanges 22*a*. Each end of the plurality of engagement portions P may be supported by a peripheral edge portion of the corresponding flange 22*a*. In the present embodiment, the wheel 22 may include ten engagement portions P, i.e., P1 to P10, as shown in FIG. 9. Each of the plurality of engagement portions P may be formed to have a cylindrical shape.

As shown in, for example, FIG. 9, the plurality of engagement portions P may be arranged in a specified area in and along a peripheral direction of the wheel 22. In the present embodiment, ten engagement portions P may be arranged at equal intervals. The engagement portions P may be arranged to cover an area of approximately three quarters of the circumference of the wheel 22. In other words, no engagement portion P may be disposed in a remaining portion of the peripheral portion of the wheel 22. In the following explanation, the area in which no engagement portion is disposed may be referred to as a recessed portion 26. As shown in FIG. 9, a left side of the wheel 22 may enter the driving passage 2*a* through a window 25*b* formed in the lift mechanism case 25. Each of the plurality of engagement portions P may engage a corresponding engaged portion L of the driver 15 in the driving passage 2*a*.

As shown in FIG. 9, a plurality of engaged portions L may be formed on a right side of the driver 15. In the present embodiment, ten engaged portions L may be arranged at equal intervals in a longitudinal direction of the driver 15, which corresponds to an up-down direction in FIG. 9. Each of the engaged portions L may have a rack-tooth shape extending in a right direction. The driver 15 and the piston 13 may return upwards due to the rotation of the wheel 22, as each of the engagement portions P of the wheel 22 engaging a corresponding engaged portion L of the driver 15. As indicated by an arrow R in FIGS. 9, 10, and 11, the wheel 22 may rotate, for instance in a counterclockwise direction, by activation of the electric motor 32.

FIG. 9 shows a standby state of the tool main body 10. In the standby state of the tool main body 10, the driver 15 and the piston 13 may be held slightly below an upper end position. Furthermore, in the standby state, an engagement portion P, which is disposed forwardly adjacent to the recessed portion 26 of the wheel 22 in the rotation direction of the wheel 22, may engage a lower surface of a lowermost engaged portion L of the driver 15. In the following explanation, the engagement portion P adjacent to the recessed portion 26 in the rotation direction of the wheel 22 may be referred to as a last engagement portion P10. Correspondingly, the lowermost engaged portion L of the driver 15 may be referred to as a last engaged portion L10.

Figure 10:
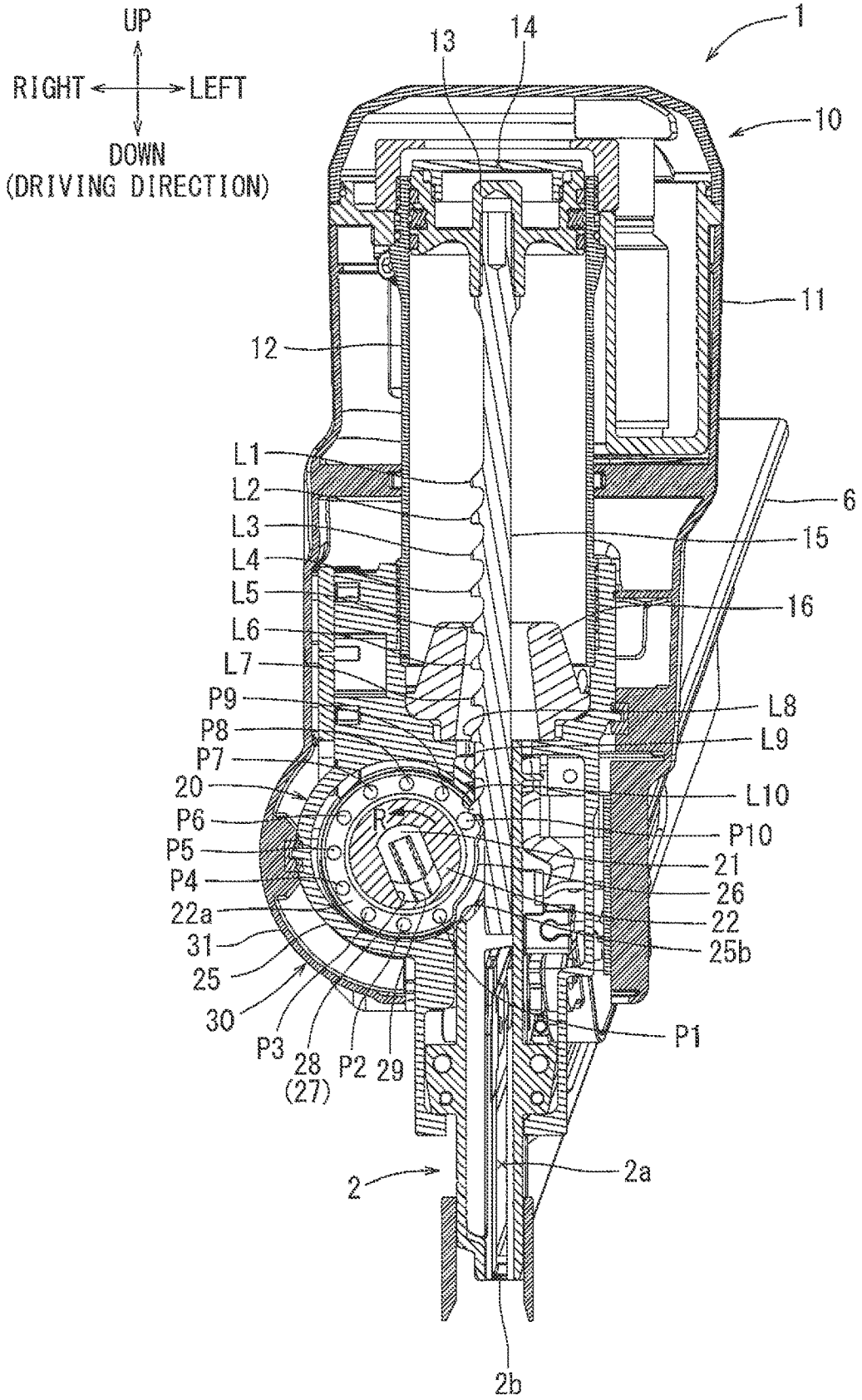
FIG. 10 is a longitudinal cross-sectional view of the tool main body of the driving tool, showing that a driver is disposed at an upper end position.

When the switch lever 3*a* is pulled, or another suitable operation is performed, in the standby state, the electric motor 32 may be activated. When the wheel 22 rotates, for instance in the counterclockwise direction, by activation of the electric motor 32, the piston 13 and the driver 15 may move upwards from a standby position. The piston 13 and the driver 15 may move upward due to the engagement of the last engagement portion P10 with the last engaged portion L10. Because of this configuration, as shown in FIG. 10, the piston 13 and the driver 15 may reach the upper end position, which is a state just before a driving operation is performed.

In the state just before the driving operation is performed, the last engagement portion P10 may be in a state just before disengaging from the last engaged portion L10. When the wheel 22 further rotates, for example in the counterclockwise direction, the last engagement portion P10 may disengage from the last engaged portion L10. Because of this configuration, the piston 13 and the driver 15 may move downwards owing to the gas pressure in the accumulation chamber 14. The driver 15 may move downwards in the driving passage 2*a*, thereby driving a driving member N. While the driver 15 moves downwards, all of the engagement portions P may retreat from the driving passage 2*a*, so as be located in the mechanism case 25. Correspondingly, the recessed portion 26 of the wheel 22 may be located in or adjacent to the driving passage 2*a*. Because of this configuration, an interference of the engagement portions P with respect to the engaged portions L may be prevented, thereby allowing for the performance of a smooth driving operation.

Figure 11:
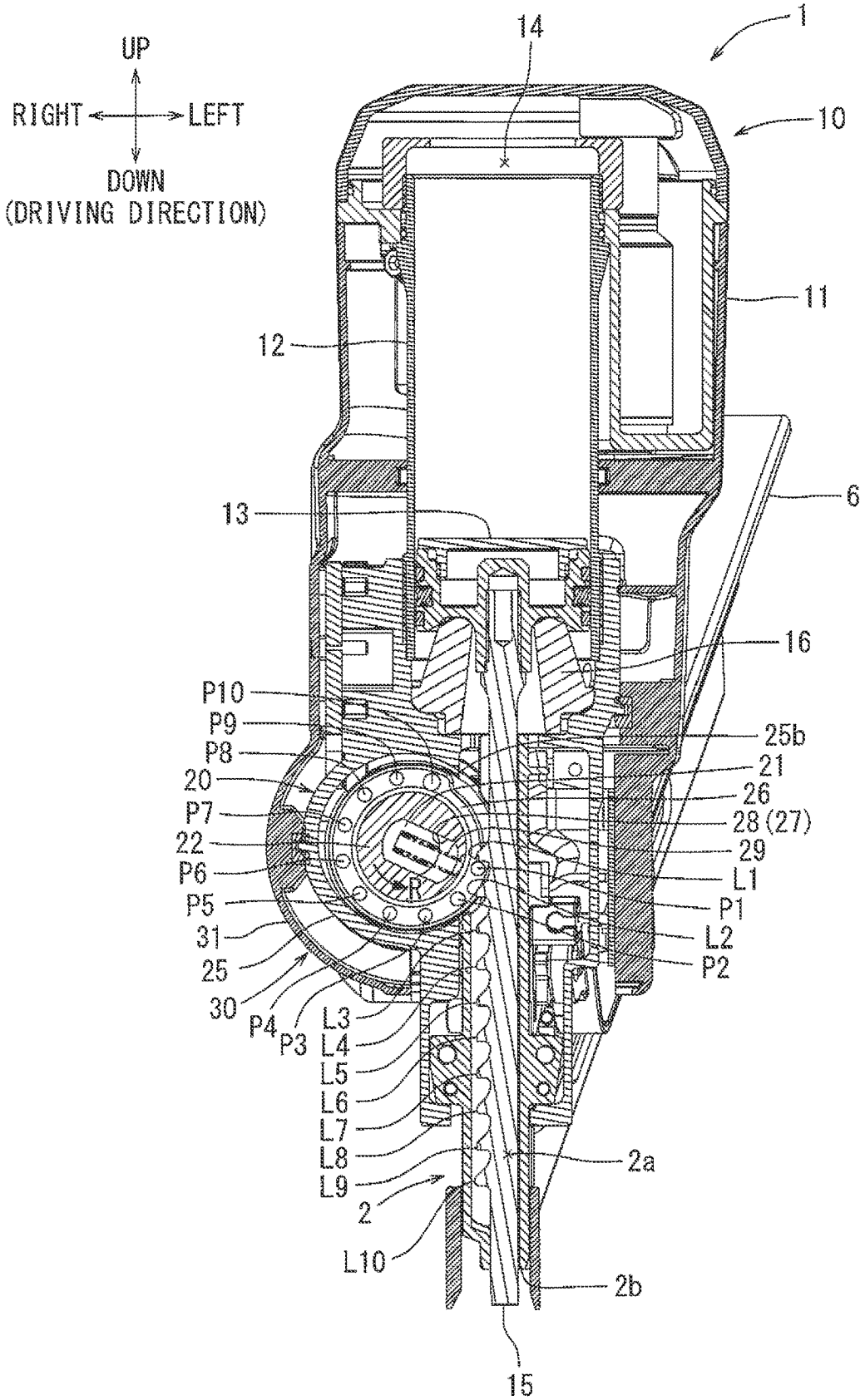
FIG. 11 is a longitudinal cross-sectional view of the tool main body of the driving tool, showing that the driver is disposed at a lower end position.

After the driving member N has driven, e.g. the driver 15 has reached a lower end position, the wheel 22 may continue to rotate, for example in the counterclockwise direction. Because of this configuration, as shown in FIG. 11, an engagement portion P, which is disposed rearwardly adjacent to the recessed portion 26 of the wheel 22 in the rotation direction of the wheel 22, may engage a lower surface of an uppermost engaged portion L of the driver 15. In the following explanation, the engagement portion P rearwardly adjacent to the recessed portion 26 in the rotation direction of the wheel 22 may be referred to as a first engagement portion P1. Correspondingly, the uppermost engaged portion L of the driver 15 may be referred to as a first engaged portion L1.

The wheel 22 may continue to rotate, in the counterclockwise direction, while the first engagement portion P1 is engaged with the first engaged portion L1. Then, a second engagement portion P2 may engage a lower surface of a second engaged portion L2. Next, a third engagement portion P3 may engage a lower surface of a third engaged portion L3. According to the rotational position of the wheel 22, a fourth engagement portion P4, a fifth engagement portion P5, a sixth engagement portion P6, a seventh engagement portion P7, an eighth engagement portion P8, a ninth engagement portion P9, and the last engagement portion P10 may engage a lower surface of a fourth engaged portion L4, a fifth engaged portion L5, a sixth engaged portion L6, a seventh engaged portion L7, an eighth engaged portion L8, a ninth engaged portion L9, and the last engaged portion L10, respectively, in a successive manner. Because of this successive engagement of the engagement portion P with the corresponding engaged portion L, the driver 15 and the piston 13 may move upwards. The above-mentioned standby state may be obtained when the last engagement portion P10 engages the last engaged portion L10. When the driver 15 and the piston 13 reach the standby state, the electric motor 32 may stop. This may be done, for example, by controlling an amount of time passed since activation of the electric motor 32. A sequence of the driving operation may be completed when the driver 15 and the piston 13 return to the standby state.

In a driving operation, clogging of the driving passage 2*a*, for instance due to a deformed driving member N, sometimes occurs when a driving member N is not fully or properly driven into the workpiece W by the downward movement of the driver 15. In this case, the driver 15 may stop at a position higher than the lower end position. An example of such a higher position is a position shown by a two-dot line in FIG. 12. In such a situation, where the driver 15 has been stopped at the higher position, the wheel 22 may continue to rotate. Because of this, a relative positional shift of the engagement portions P with regard to the previously corresponding engaged portions L may occur.

Figure 12:
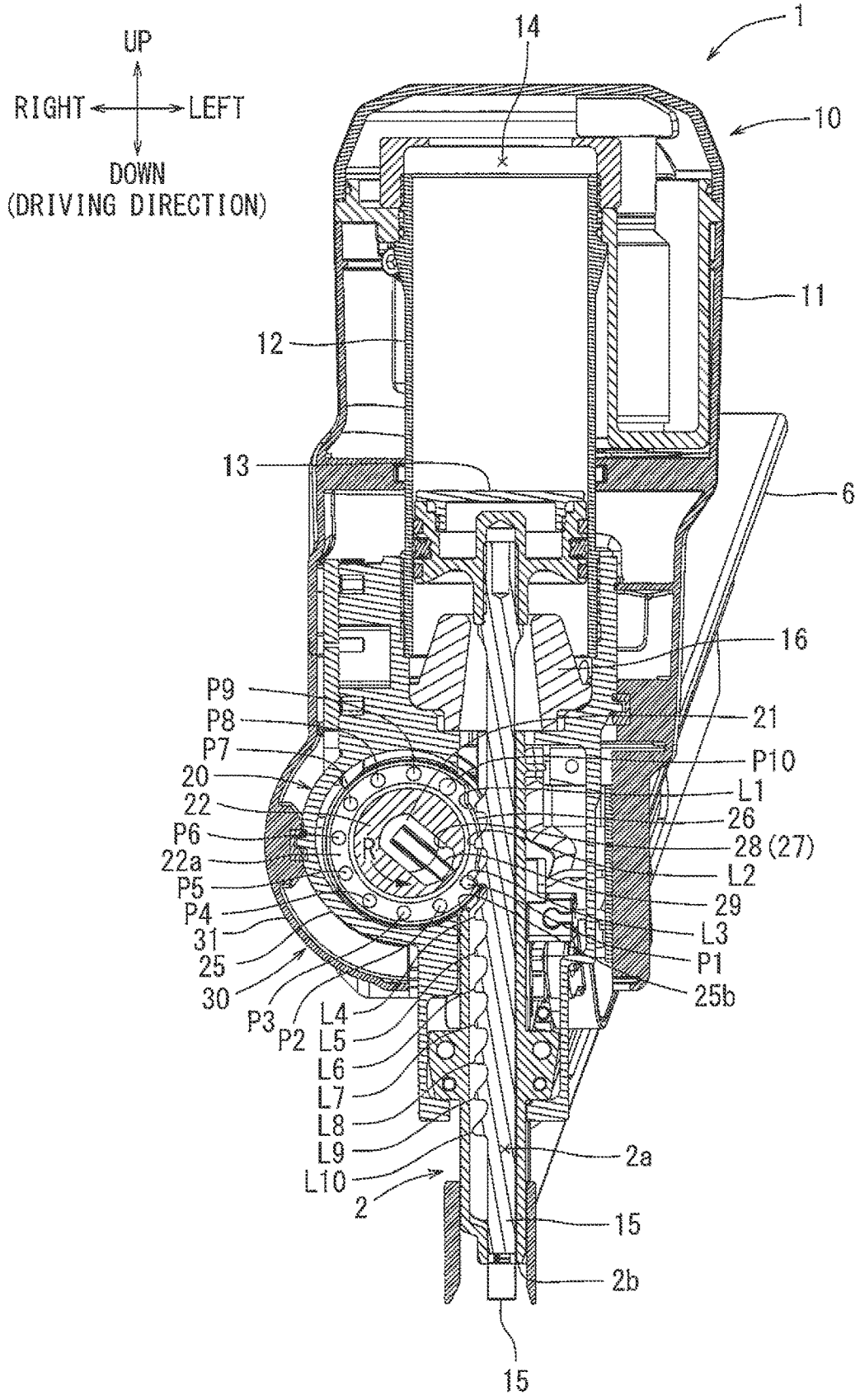
FIG. 12 is a longitudinal cross-sectional view of the tool main body of the driving tool, showing that the driver is in a locked state in which a downward movement of the driver has stopped at a position near the lower end position.
Figure 13:
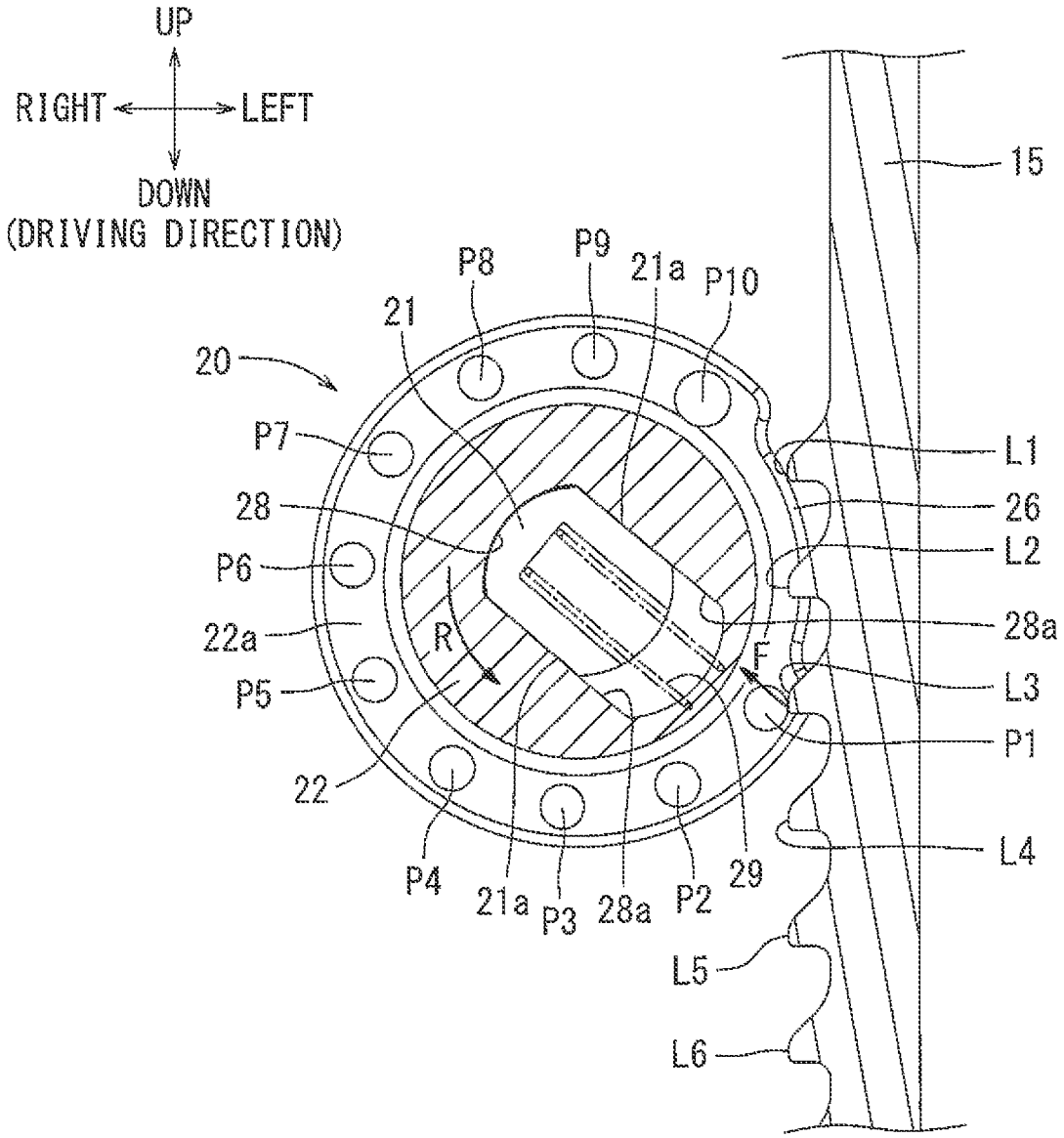
FIG. 13 is a partly enlarged view of FIG. 12, showing a state of the engagement portion with respect to an engaged portion being in the locked state. This figure shows a state in which a first engagement portion interferes with a third engaged portion.

For example, as shown in FIGS. 12 and 13, a positional shift may happen such that the first engagement portion P1 does not engage the lower surface of the first engaged portion L1. Instead, for instance, the first engagement portion P1 may contact a portion of the third engaged portion L3. As a measure to account for such a situation, a lift mechanism 20 may include a displacement allowing mechanism 27. The displacement allowing mechanism 27 may allow a position of the engagement portion P to be displaced relative to the lower surface of the engaged portion L. For example, the engagement portion P may be displaced to a displacement allowing space. As shown in FIG. 13, the displacement allowing mechanism 27 may include an insertion hole 28 formed in the wheel 22. A pair of slide surfaces 28*a*, formed parallel to each other and extending in a radial direction of the wheel 22, may be formed on an inner wall surface of the insertion hole 28. The insertion hole 28 may be formed in an oblong hole shape in the radial direction of the wheel 22. Such a shape allows the wheel 22 to be displaced in the radial direction of the rotation shaft 21. The rotation shaft 21 may be inserted into the insertion hole 28. A pair of supporting surfaces 21*a* may be formed on an outer peripheral surface of the rotation shaft 21. Each of the pair of supporting surfaces 21*a* may face a corresponding slide surface 28*a* and extend in the radial direction of the wheel 22.

The pair of supporting surfaces 21*a* of the rotation shaft 21 may slidably contact the pair of slide surfaces 28*a* of the insertion hole 28. Thus, the wheel 22 may be supported by the rotation shaft 21, such that the wheel 22 can both rotate integrally with the rotation shaft 21 and be displaced in the radial direction of the rotation shaft 21, within a fixed range. A displacement of the wheel 22 in the radial direction of the rotation shaft 21 may avoid an interference of the engagement portions P by the engaged portions L. A compression spring 29 may be housed between the inner wall surface of the insertion hole 28 and the rotation shaft 21. Owing to a biasing force of the compression spring 29, the wheel 22 may be biased in a direction in which the engagement portion P approaches the engaged portion L of the driver 15. Because of this configuration, a displacement of the engagement portion P in the radial direction of the rotation shaft 21 away from the engaged portion L may be performed against the biasing force of the compression spring 29.

Figure 14:
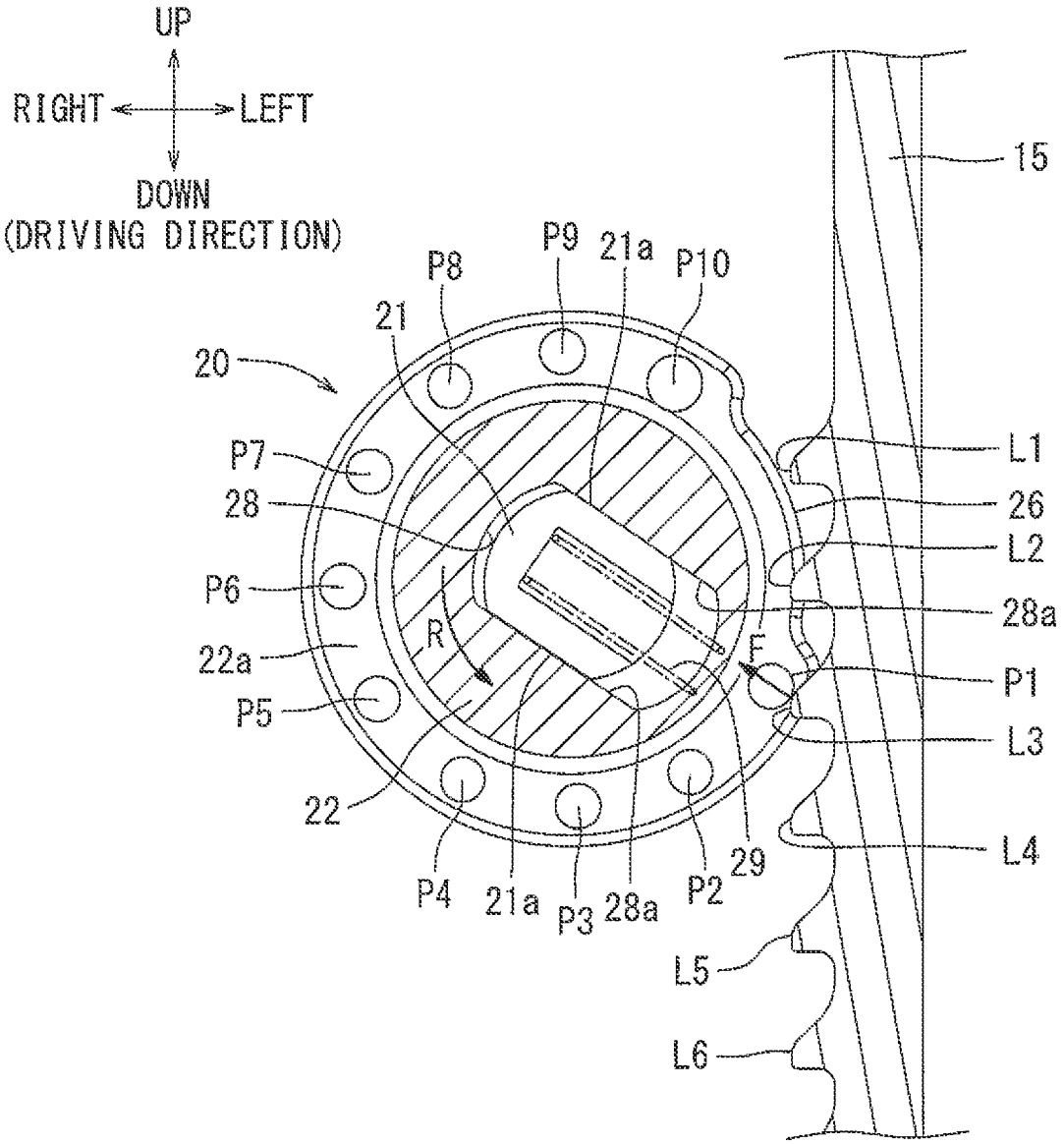

As shown in FIG. 14, when an external force F, which the first engagement portion P1 receives from the third engaged portion L3 of the driver 15 in this example, becomes larger than the biasing force of the compression spring 29 due to the rotation of the wheel 22, an entirety of the wheel 22 may be displaced in the radial direction of the rotation shaft 21 and against the compression spring 29. Because of this displacement of the wheel 22, the further interference of the first engagement portion P1 by the engaged portion L3 (which resulted in an engagement locked state) may be avoided. As a result, the wheel 22 may rotate smoothly again by releasing interference of the engagement portions P of the wheel 22 from the engaged portions L of the driver 15.

Figure 15:
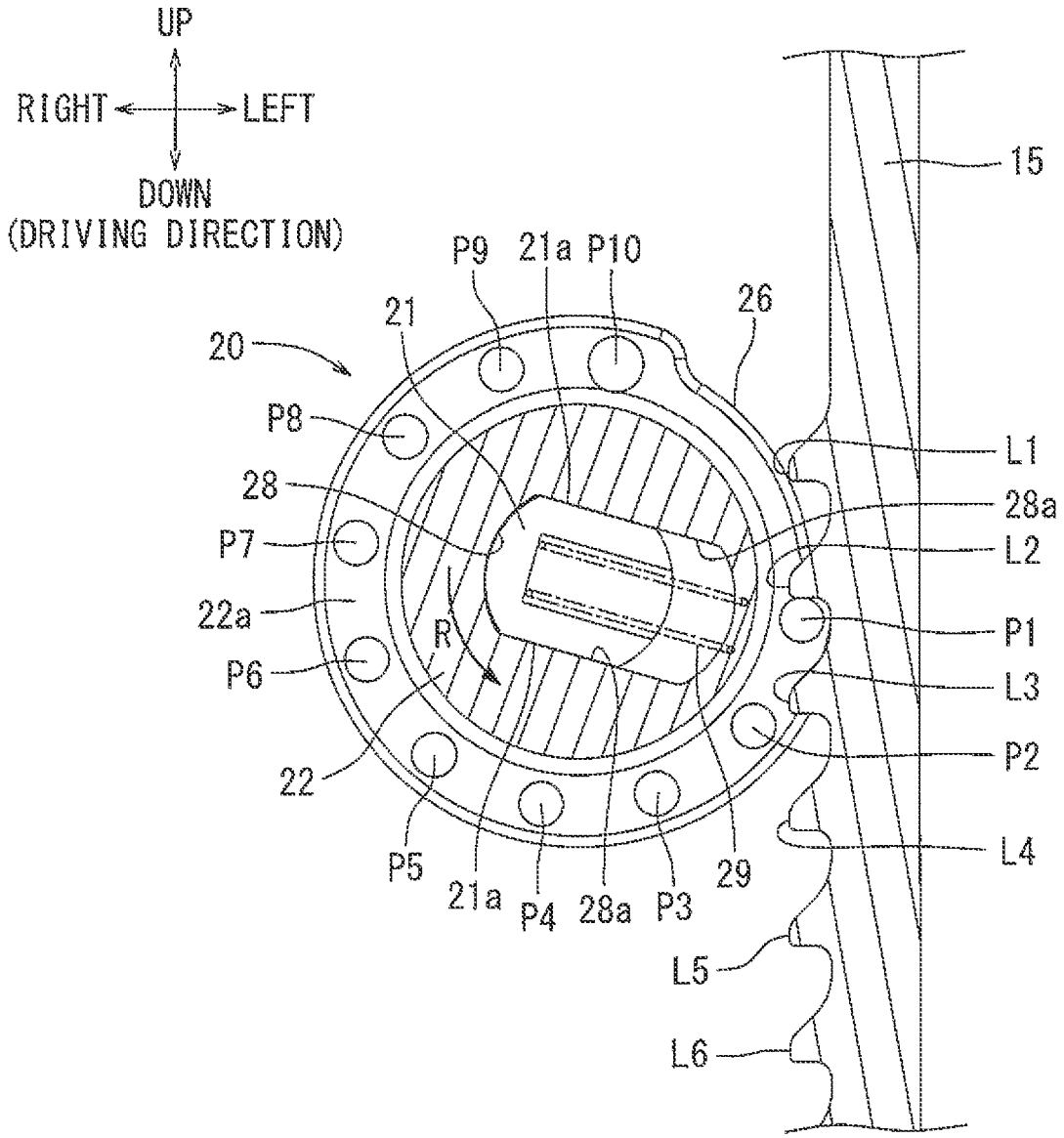
FIG. 15 is a state of the engagement portion with respect to an engaged portion is in the locked state. This figure shows a state in which the first engagement portion engages a second engaged portion.

When the wheel 22 rotates while being displaced in a direction away from the driver 15, the first engagement portion P1 may pass over a lateral side of the third engaged portion L3. After the first engaging portion P1 passes over the lateral side of the third engaging portion L3, the external force F that the first engagement portion P1 receives from the third engaged portion L3 may decrease. As a result, as shown in FIG. 15, the wheel 22 may return in a direction approaching the driver 15 owing to the biasing force of the compression spring 29. This movement of the wheel 22 may allow the first engagement portion P1 to then contact a lower surface of the second engaged portion L2. After that, as will be discussed later, a lock member 41 may be inserted into the insertion hole 28, thereby restricting the displacement of the wheel 22 in the radial direction of the rotation shaft 21.

As discussed above, a timing for when a state in which the wheel 22 is allowed to be displaced in the radial direction of the rotation shaft 21 is changed to a state in which the wheel 22 is restricted from being displaced may be set when the first engagement portion P1 would normally engage an engaged portion 1, of the driver 15 (for instance at a timing where there is not in an interference state). Alternatively, any desirable timing may be adopted. For example, the timing may be set when the second engagement portion P2 would normally engage an engaged portion L of the driver 15.

After the first engagement portion P1 engages the engaged portion L (properly and without the interference state), the driver 15 may move upwards, by rotation of the wheel 22, from the position in which the driver 15 was stopped. When the driver 15 moves into the standby position by the rotation of the wheel 22, the electric motor 32 may stop. In this state, which generally corresponds to a state in which the driver 15 may not move unless the switch lever 3*a* is pulled, the user may easily remove the deformed driving member N clogging in the driving passage 2*a*.

With the displacement allowing mechanism 27 of the present disclosure, the displacement of the wheel 22 in the radial direction of the rotation shaft 21 may be allowed within a predetermined range, which may correspond to a range in which the first engagement portion P1 may engage the engaged portion L. When a subsequent engagement portion (P2-P10), subsequent to the first engagement portion, engages the engaged portion L of the driver, displacement of the wheel 22 in the radial direction of the rotation shaft 21 may be restricted by the displacement restricting mechanism 40. A detailed embodiment of the displacement restricting mechanism 40 is shown in FIGS. 3-8.

Figure 7:
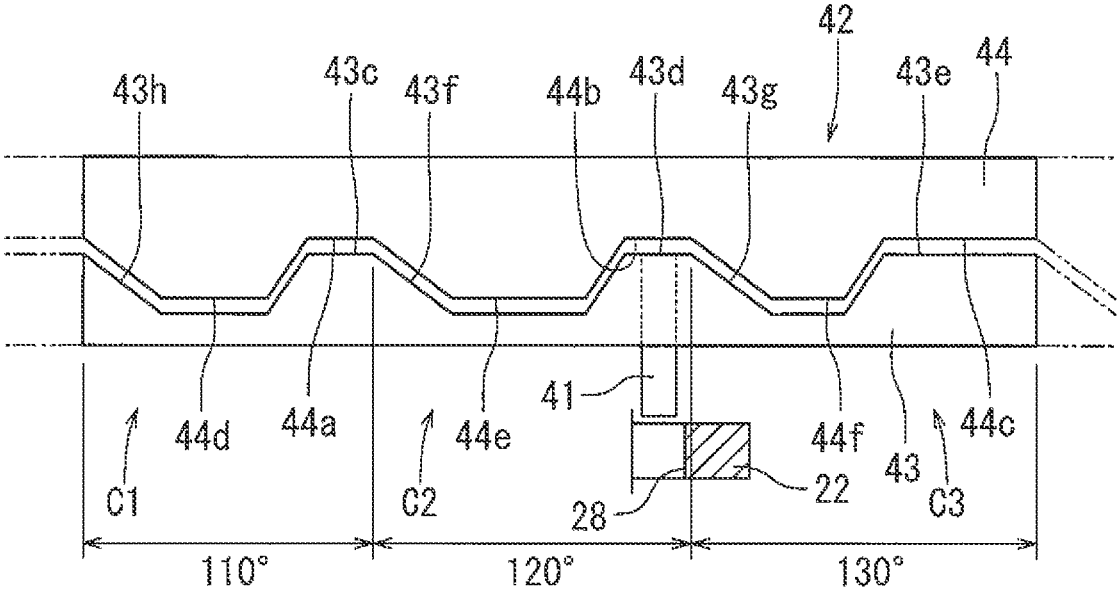
FIG. 7 is a development view of the cam mechanism, showing each top portion of the rotation cam engaging a corresponding bottom portion of a fixed cam, thereby allowing the rotation cam to be displaced upward in this figure.
Figure 8:
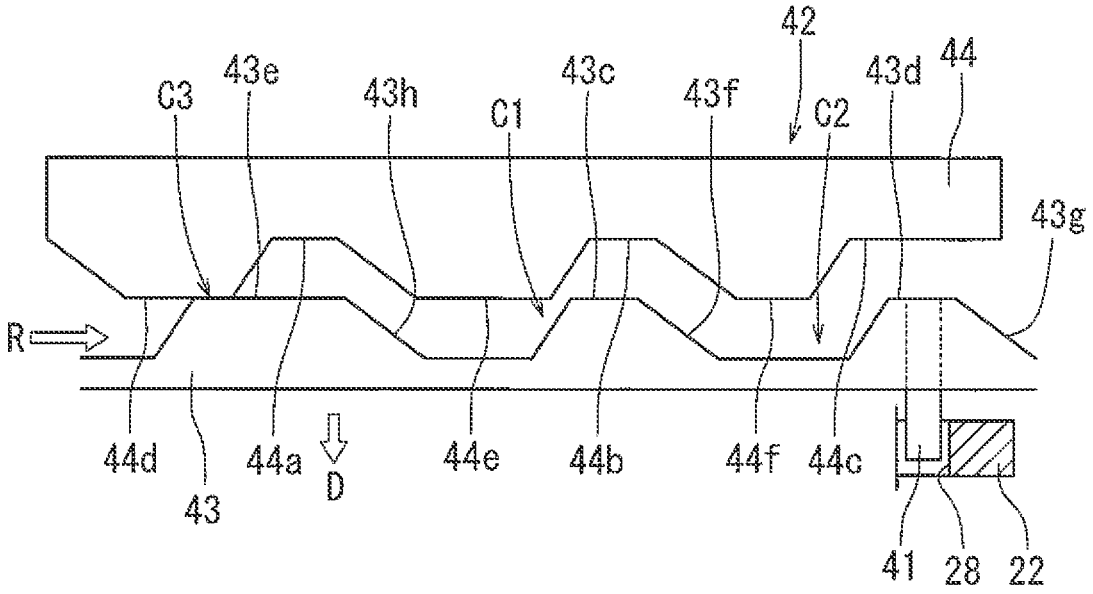
FIG. 8 is a development view of the cam mechanism, showing top portions of the rotation cam disengaged from bottom portions of the fixed cam, thereby causing the rotation cam to be displaced downward in this figure.
Figure 16:
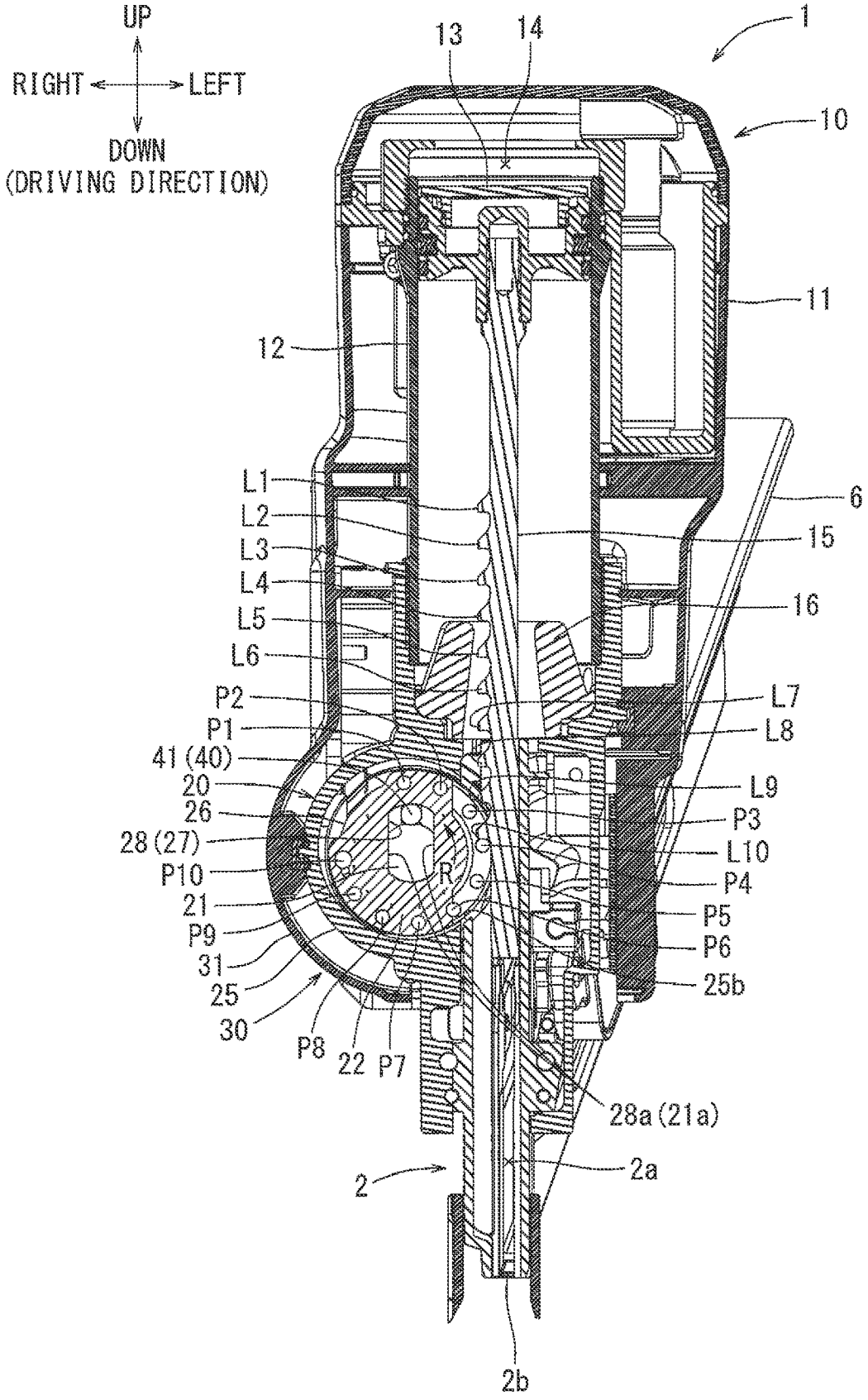
FIG. 16 is a longitudinal cross-sectional view of the tool main body of the driving tool, showing a displacement restricting state in which a lock member has been inserted to an insertion hole.

The displacement restricting mechanism 40 may include a lock member 41. The lock member 41 may have a cylindrical shape having a longitudinal axis. As shown in FIGS. 5, 8, and 16, the wheel 22 may be restricted from being displaced in the radial direction of the rotation shaft 21 when the lock member 41 is inserted between the inner wall surface of the insertion hole 28 and the rotation shaft 21. In contrast, as shown in FIGS. 4 and 7, the wheel 22 may be allowed to be displaced in the radial direction of the rotation shaft 21 when the lock member 41 is retracted from the insertion hole 28.

As shown in, for example, FIG. 16, the lock member 41 may advance into and retract from the insertion hole 28 by the movement of the lock member 41 in an axial direction of the rotation shaft 21 (which is parallel to a direction of the motor axis line J in this embodiment). The advancing/retracting movement of the lock member 41 into/from the insertion hole 28 may be performed by a cam mechanism 42. The cam mechanism 42 may include a disc-shaped rotation cam 43 and a disc-shaped fixed cam 44. The rotation cam 43 and the fixed cam 44 may be coaxially supported by the rotation shaft 21.

Figure 6:
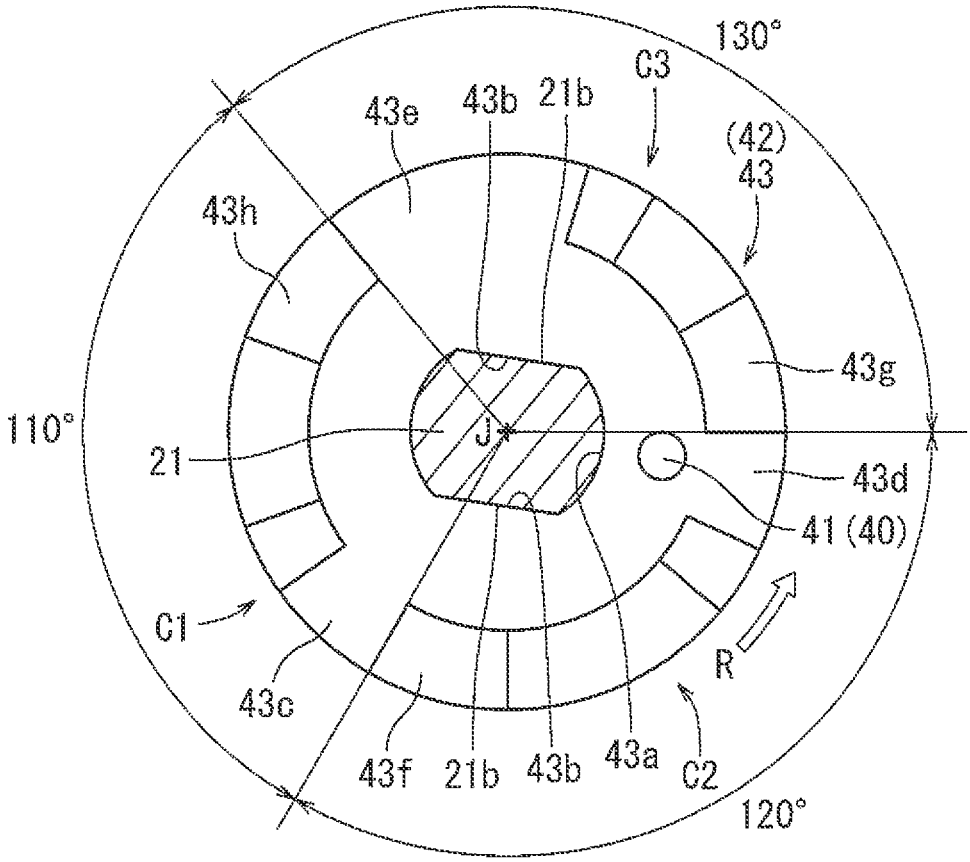
FIG. 6 is a cross-sectional view taken along line VI-VI of FIG. 4, showing a plan view of a rotation cam.

As shown in FIG. 6, the rotation shaft 21 may be inserted into a supporting hole 43*a* of the rotation cam 43. Two flat receiving surfaces 43*b* parallel to each other may be formed on an inner wall surface of the supporting hole 43*a*. Two flat supporting surfaces 21*b*, each of which faces a corresponding flat receiving surface 43*b* of the supporting hole 43*a*, may be formed on rotation shaft 21. The rotation cam 43 may be supported by the rotation shaft 21 such that each of the receiving surfaces 43*b* slidably contacts the corresponding supporting surface 21*b*. Because of this configuration, the rotation cam 43 and the rotation shaft 21 may be configured such that the rotation cam 43 rotates integrally with the rotation shaft 21, which in this embodiment is around the motor axis line S. The rotation cam 43 can also move in a direction along the rotation shaft 21, which in this embodiment is along the motor axis line J, with regard to the rotation shaft 21. As indicated by a void arrow R in HG. 6, the rotation cam 43 may rotate in the counterclockwise direction. In the figures, the void arrow R shows a rotational direction of the rotation shaft 21, the wheel 22, and the rotation cam 43.

Figure 4:
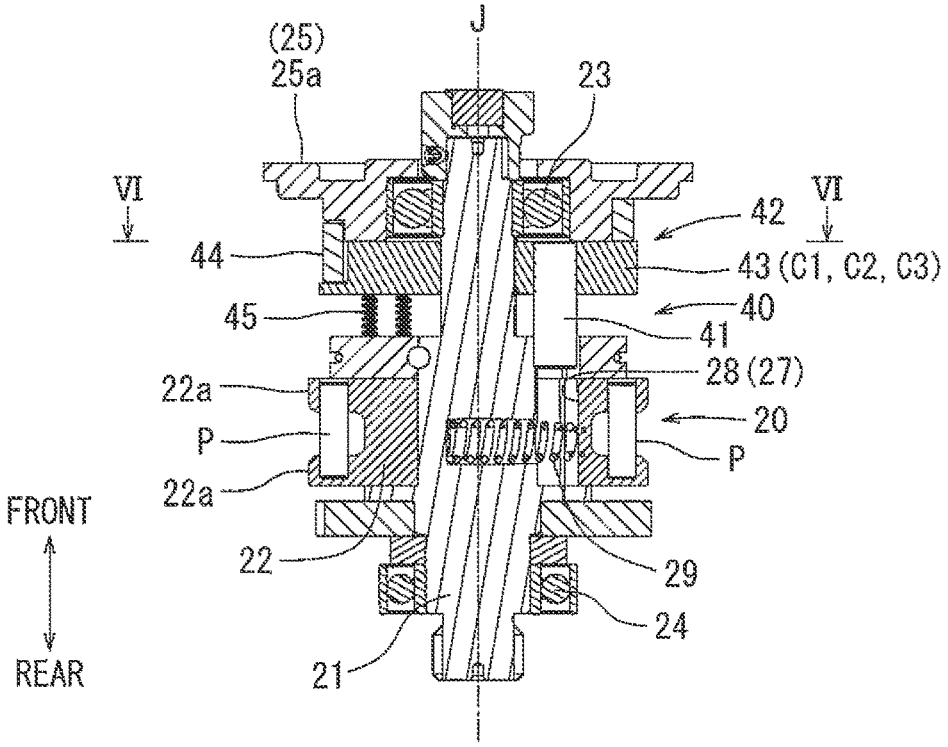
FIG. 4 is a lateral cross-sectional view of the lift mechanism and the displacement allowing mechanism according to the first embodiment, showing an engagement portion in a displacement allowing state in which the engagement portion is allowed to be displaced in a radial direction of the engagement portion.
Figure 5:
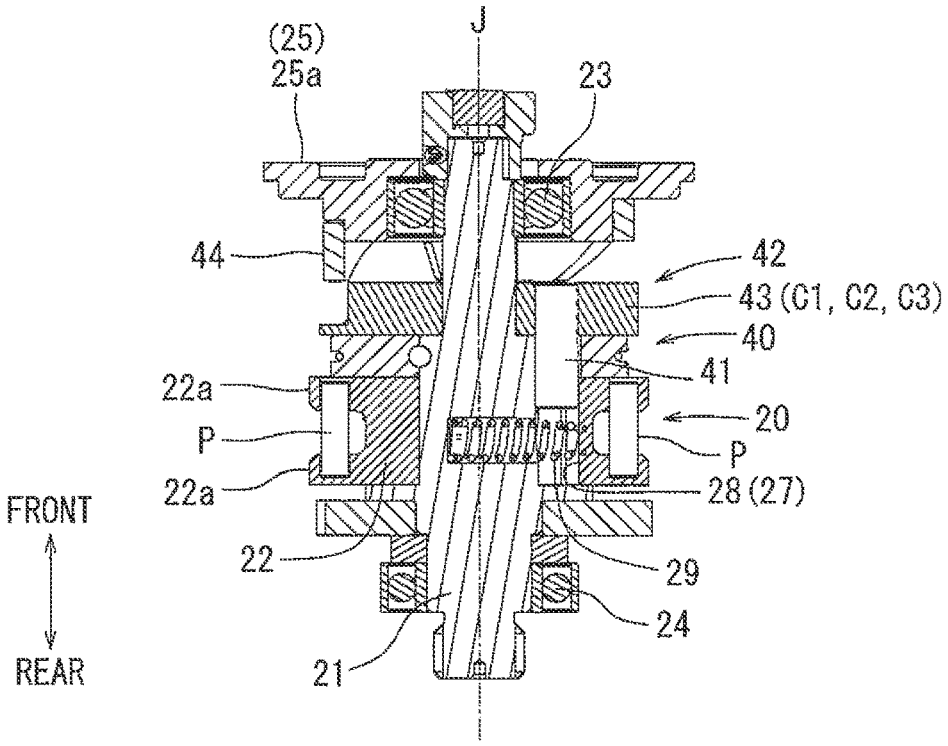
FIG. 5 is a lateral cross-sectional view of the lift mechanism and the displacement allowing mechanism according to the first embodiment, showing an engagement portion in a displacement restricting state in which the engagement portion is restricted from being displaced in the radial direction of the engagement portion.

As shown in FIGS. 4, 5, and 6, the lock member 41 may be integrally formed with or attached to the rotation cam 43. The lock member 41 may protrude from a rear surface of the rotation cam 43, for instance in a rearward direction. The lock member 41 may be disposed parallel to the motor axis line J. Furthermore, the lock member 41 may be disposed in a position on an inner peripheral side of the engagement portions P of the wheel 22. The lock member 41 may rotate integrally with the rotation cam 43, which rotates around the motor axis line J. The lock member 41 can also move integrally with the rotation cam 43 in the direction along the rotation shaft 21, which is in the direction along the motor axis line J.

A plurality of compression springs 45, for example, three compression springs 45, may be disposed at equal intervals in a peripheral direction between the rear surface of the rotation cam 43 and the front surface of the wheel 22. The compression springs 45 are shown in FIGS. 2 and 4. The rotation cam 43 may be biased in a direction approaching the fixed cam 44 (e.g., in a forward direction) by a biasing force of the compression springs 45. Because of this configuration, the lock member 41 may be biased in a retraction direction from the insertion hole 28.

As shown in FIGS. 6 and 7, a first cam C1, a second cam C2, and a third cam C3 may be formed on a peripheral edge of the rotation cam 43. Each of the three cams C1, C2, and C3 may include a flat top portion, a flat bottom portion, and a lift portion that transitions between the top portion and the bottom portion. As shown in FIGS. 6 and 7, three top portions 43*c*, 43*d*, and 43*e* may be disposed at unequal intervals around the peripheral edge (which corresponds to the motor axis line J in this embodiment), for example, with spacings of 110 degrees, 120 degrees, and 130 degrees to each other. Each of the three top portions 43*c*, 43*d*, and 43*e* may have a different length than each other, as measured in an area in a rotational direction (in an area in a circumferential direction). The first top portion 43*c* and the second top portion 43*d* may be shorter than the third top portion 43*e*. The third top portion 43*e* may be the longest of the three top portions 43*c*, 43*d*, and 43*e*. The first top portion 43*c* may be configured to have approximately the same length as the second top portion 43*d*.

Three lift portions 43*f*, 43*g*, 43*h* may be formed on a front side of the first to third top portions 43*c*, 43*d*, 43*e*, respectively, in the rotational direction. The lift portions 43*f*, 43*g*, 43*h* may guide the fixed cam 44 toward the top portions 43*c*, 43*d*, 43*e*. The three lift portions 43*f*, 43*g*, 43*h* may have the same length, as measured in the area in the circumferential direction. Thus, the three lift portions 43*f*, 43*g*, 43*h* may have the same tilt angle relative to the rotational direction. Furthermore, the three lift portions 43*f*, 43*g*, 43*h* may be disposed at unequal intervals in the circumferential direction, in a similar manner as the three top portions 43*c*, 43*d*, 43*e*. Because of this configuration, the rotation cam 43 can be displaced in a direction parallel to the direction of the motor axis line J, especially in a rearward direction (which is in a direction in which the lock member 41 is inserted into the insertion hole 28 on a locked side).

The fixed cam 44 may work to receive the rotation cam 43 by engaging the first to third top portions 43*c*, 43*d*, 43*e* of the rotation cam 43. The fixed cam 44 may be fixed to the cover 25*a* of the lift mechanism case 25. Thus, contrary to the rotation cam 43, the fixed cam 44 may be fixed so as not to be rotatable around the motor axis line J. The fixed cam 44 may also not be movable in the direction along the motor axis line J. As shown in HG. 7, the fixed cam 44 may include three bottom portions 44*a*, 44*b*, 44*c* and three top portions 44*d*, 44*e*, 44*f*. The three bottom portions 44*a*, 44*b*, 44*c* may be disposed at unequal intervals around the motor axis line J. Each of the three bottom portions 44*a*, 44*b*, 44*c* may have a different length than each other as measured in the area in the circumferential direction. The first bottom portion 44*a* and the second bottom portion 44*b* may be shorter than the third bottom portion 44*c*. The third bottom portion 44*c* may be the longest of the three bottom portions 44*a*, 44*b*, 44*c*. The third bottom portion 44*c* of the fixed cam 44 may be configured to receive the third top portion 43*e* of the rotation cam 43. The first bottom portion 44*a* of the fixed cam 44 may be configured to have approximately the same length as the second bottom portion 44*b*.

The first bottom portion 44*a* and the second bottom portion 44*b* of the fixed cam 44 may be configured to be shorter than the third top portion 43*e* of the rotation cam 43. Because of this configuration, the third top portion 43*e* of the rotation cam 43 cannot advance into the first bottom portion 44*a* or the second bottom portion 44*b* of the fixed cam 44.

When the rotation cam 43 rotates in the direction indicated by the arrow R (for example from the position shown in FIG. 8) and the third top portion 43*e* of the rotation cam 43 moves below the third bottom portion 44*c* of the fixed cam 44, the rotation cam 43 may be displaced in the direction approaching the fixed cam 44 (in the forward direction in FIG. 4), for instance due to the biasing force of the compression spring 45. Because of this displacement of the rotation cam 43, the lock member 41 may retract from the insertion hole 28 of the wheel 22 in the forward direction, thereby causing the wheel 22 to be able to move in the radial direction of the rotation shaft 21.

FIG. 7 shows an embodiment of an engagement state of the cam mechanism 42. In this engagement state, the third top portion 43*e* of the rotation cam 43 has moved below the third bottom portion 44*c* of the fixed cam 44. Thereby, the rotation cam 43 is displaced in the direction approaching the fixed cam 44 by the biasing force of the compression spring 45. In this engagement state of the cam mechanism 42, the lock member 41 may retract from the insertion hole 28. Consequently, the wheel 22 may be in a state in which it is able to move in the radial direction of the rotation shaft 21. The wheel 22 may also be in a state in which it is not in a displacement restricting state. This engagement state may occur when the rotation cam 43 engages the fixed cam 44. In some embodiment, the engagement state of the rotation cam 42 may only occur in a predetermined area in the rotational direction of the wheel 22. Because of this configuration, the advancing/retracting movement of the lock member 41 information the insertion hole 28 may be performed within a predetermined angle range relating to the rotation of the wheel 22, which will be discussed in more detail below.

A relative position of the rotation cam 43, which is configured to rotate integrally with the wheel 22, with regard to the fixed cam 44 may be configured such that the third top portion 43*e* of the rotation cam 43 is located below the third bottom portion 44*c* of the fixed cam 44 when the first engagement portion P1 engages an engaged portion L of the driver 15. Because of this configuration, before the further movement of the first engagement portion P1 is interfered with by the engaged portion L, the lock member 41 may be in a state where it is retracted from the insertion hole 28. Because of this relative positioning, the wheel 22 is allowed to move in the radial direction of the rotation shaft 21. Allowance of the wheel 22 to move in the radial direction of the rotation shaft 21 may accommodate for interference of the engagement portion P of the wheel 22 with the engaged portion L of the driver 15.

For the purposes of the following discussion, a timing before further movement of the first engagement portion P1 is interfered with by the engaged portion L may correspond to an initial state in which the first engagement portion P1 of the wheel 22 engages an engaged portion 1, of the driver 15. Upon such engagement and as the wheel 22 is further rotated, the driver 15 may start to move upwards. In the present embodiment, for example, a relative position of the rotation cam 43 with regard to the fixed cam 44, relative around the motor axis line 1, may be configured such that the displacement of the wheel 22 in the radial direction of the rotation shaft 21 may be allowed when the first engagement portion P1 enters the driving passage 2*a* through the window 25*b* of the lift mechanism case 25 (for example, see FIG. 12, which is a state immediately before the first engagement portion P1 engages the third engaged portion L3).

FIG. 8 shows an embodiment of a disengagement state of the cam mechanism 42. As shown in FIG. 8, when the third top portion 43*e* of the rotation cam 43 is offset in the rotation direction with respect to the third bottom portion 44*c* of the fixed cam 44 (which may be a state in which the third top portion 43*e* is not located below the third bottom portion 44*c*), a part of the third top portion 43*e* of the rotation cam 43 may contact the third top portion 44*d* of the fixed cam 44. This may occur even if the first and second top portions 43*c*, 43*d* of the rotation cam 43 are located below the second and third bottom portions 44*b*, 44*c* of the fixed cam 44, respectively. Because of this configuration, the rotation cam 43 may be prevented from moving forward. In other words, the rotation cam 43 may be in a disengagement state with respect to the fixed cam 44. In the disengagement state, the rotation cam 43 may be retained in a position in which the rotation cam 43 is displaced rearwards, which is a direction against the compression spring 43 (in a direction indicated by a void arrow D in FIG. 8). Because of this configuration, the lock member 41 may be retained in a state where it is inserted into the insertion hole 28. Thereby, the wheel 22 may be restricted from being displaced in the radial direction of the rotation shaft 21.

The rotation cam 43 may engage the fixed cam 44 again when the third top portion 43*e* of the rotation cam 43 is located below the third bottom portion 44*c* of the fixed cam 44, for example by rotation of the wheel 22 in the direction indicated by the arrow R. When the rotation cam 43 moves forwards (e.g., toward the fixed cam 44), the lock member 41 may retract from the insertion hole 28. This enables the wheel 22 to again be displaceable in the radial direction of the rotation shaft 21. As discussed above, the retracting movement of the lock member 41 from the insertion hole 28 may be performed at a predetermined angle relating to the rotation of the wheel 22. In the present disclosure, the retraction of the lock member 41 may occur in a predetermined period when the first engagement portion P1 is configured to engage the engaged portion L of the driver 15.

For example, in the present disclosure, just after the first engagement portion P1 has engaged an engaged portion L or just before the second engagement portion P2 engages an engaged portion L, the lock member 41 may be allowed to advance into the insertion hole 28. Thereby, the wheel 22 may be restricted from being displaced in the radial direction of the rotation shaft 21. When the second engagement portion P2 engages the engaged portion L, the first engagement portion P1 has already engaged the corresponding engaged portion L. Because of this engagement, the driver 15 may slightly move upwards. Accordingly, a relative position of the second engagement portion P2 with respect to the engaged portion L may have been corrected. The relative positioning may have been corrected such that the second engagement portion P2 smoothly engages the engaged portion L. Accordingly, when the second engagement portion P2 engages the engaged portion L, it may be preferable that the wheel 22 is restricted from being displaced in the radial direction of the rotation shaft 21. For instance, it may be preferable that the wheel 22 is not allowed to move in the radial direction of the rotation shaft 21, such that an engagement state can be obtained without fail.

By continuous rotation of the wheel 22 while the wheel 22 is in a state in which the wheel 22 is restricted from being displaced in the radial direction of the rotation shaft 21, the engagement portion from P3 to P10 may successively engage the engaged portion L, thereby moving the driver 15 upwards. As discussed above, except for during a time when there was an initial upward movement of the driver 15 by the engagement of the first engagement portion P1 with the engaged portion L, the wheel 22 may be restricted from being displaced in the radial direction of the rotation shaft 21 by the displacement restricting mechanism 40. Because of this configuration, the engagement portions from P2 to P10 may successively engage the engagement portion L without fail. Accordingly, power to move the driver 15 upwards may be reliably transferred from the wheel 22 to the driver 15 while the driver 15 continues to receive a pressure of gas in the accumulation chamber 14.

For example, as shown in FIG. 16, when a displacement direction of the wheel 22 (in a direction in which the supporting surfaces 21*a* and the slide surfaces 28*a* slide against each other) is parallel or approximately parallel to a moving direction of the driver 15 (e.g., the up-down direction), an entirety or substantial majority of the thrust power by the pressure of gas in the accumulation chamber 11 may work as an external force in a direction in which the wheel 22 could be displaced. In this case, the wheel 22 may be restricted from being displaced in the radial direction of the rotation shaft 21 because the lock member 41 has been inserted into the insertion hole 28. Because of this configuration, the power of the driving unit 30 may be reliably transferred to the driver 15 via the wheel 22. In this embodiment, this may occur up to the point in time when the fourth engagement portion P4 engages the last engaged portion L10, while the driver 15 continues to receive the thrust power of the accumulation chamber 14.

Successive engagement of the engagement portion P with the engaged portion L by rotation of the wheel 22 may return the driver 15 to the standby position. At this point, the electric motor 32 may stop and the driver 15 may be retained in the standby position. Then, as discussed above, the user can remove the deformed driving member N clogging in the driving passage 2*a*. After that, by pulling of the switch lever 3*a*, the driving unit 30 may start again and the driver 15 may move to the upper end position. After the driver 15 has moved to the upper end position, the wheel 22 may idle. The idling of the wheel 22 at the upper end position allows for correcting the positional shift of the engagement portion P with respect to the engaged portion L of the driver 15 that occurred as a result of the clog. After the positional shift has been corrected, such that the last engagement portion P10 engages the last engaged portion L10, the wheel 22 may further rotate to cause the engagement state of the engagement portion P with the engaged portion L to be released, thereby allowing the driver 15 to move downwards to perform a driving operation.

According to the driving tool 1 discussed above, the wheel 22 of the lift mechanism 20 may be displaceable in the radial direction of the rotation shaft 21 by the displacement allowing mechanism 27. Because of this configuration, an interference state of the first engagement portion P1 with respect to the engaged portion L of the driver 15, which is not a normal engagement state, may be accommodated for. Accordingly, the first engagement portion P1 may still be able to engage the lower surface of an engaged portion L. Accordingly, in a case where nail jamming occurs, the driver 15 may be returned to the standby position in a rapid and smooth manner.

In the exemplified embodiment, the interference of the first engagement portion P1 may be accommodated for by the displacement of the entirety of the wheel 22 in the radial direction of the rotation shaft 21. Accordingly, the exemplified configuration may be simplified in comparison with a configuration in which only a part of the wheel 22 is to be displaced.

The displacement of the wheel 22 in the radial direction of the rotation shaft 21 may be performed only during an initial stage of the upward movement of the driver 15 (e.g., when the first engagement portion P1 engages or is interfered with by the engaged portion L). When the second through last engagement portions (P2 to P10) engage the engaged portion L, the wheel 22 may be restricted from being displaced in the radial direction of the rotation shaft 21 by the displacement restricting mechanism 40. Because of this configuration, the driver 15 may reliably be moved upwards by the lift mechanism 20 while the driver 15 receives a pressure of the gas in the accumulation chamber 14.

In the exemplified embodiment, when the displacement direction of the wheel 22 (which may correspond to a surface direction of the slide surface 28*a*) is parallel to the movement direction of the driver 15, the displacement of the wheel 22 in the radial direction of the rotation shaft 21 may be restricted by the displacement restricting mechanism 40. When the direction in which the driver 15 moves is parallel to the direction in which the wheel 22 could be displaced, the engagement portion P may receive a large external force (a thrust force of the pressure of gas from the driver 15). Accordingly, by restricting the wheel 22 from being displaced in the radial direction of the rotation shaft 21 by use of the displacement restricting mechanism 40, at least in this stage, an engagement state of the lift mechanism 20 with respect to the driver 15 may be reliably retained. Thereby, an operation failure of the driving tool 1 may be avoided.

In the exemplified embodiment, the lock member 41 may be inserted between the insertion hole 28 of the wheel 22 and the rotation shaft 21 supporting the wheel 22. Thereby, the wheel 22 may be restricted from being displaced in the radial direction of the rotation shaft 21. In contrast, when the lock member 41 retracts from the insertion hole 28, the wheel 22 may be allowed to be displaced in the radial direction of the rotation shaft 21 By use of a simple configuration in which the lock member 41 is advancing/retracting into/from the insertion hole 28, a state of the wheel 22 may be switched between the state in which the wheel 22 is allowed to be displaced in the radial direction of the rotation shaft 21 and the state in which the wheel 22 is restricted from being displaced in the radial direction of the rotation shaft 21.

In the exemplified embodiment, the lock member 41 may advance into and retract from the insertion hole 28 by displacing the lock member 41 in the axial direction of the rotation shaft 21 (in the direction of the motor axis line J of this embodiment). In this way, the lock member 41 may advance into and retract from the insertion hole 28 by the simple and compact configuration.

In the exemplified embodiment, the displacement restricting mechanism 40 may be made more compact by arranging the lock member 41 in a position on an inner peripheral side of the engagement portion P.

In the exemplified embodiment, the lock member 41 may advance into and retract from the insertion hole 28 by interlocking its movement with the rotation of the wheel 22 using the cam mechanism 42. Accordingly, the lock member 41 may be accurately and properly displaced by the cam mechanism 42.

In the exemplified embodiment, the pair of slide surfaces 28*a* may slidably contact the pair of supporting surfaces 21*a* of the rotation shaft 21. Because of this configuration, the wheel 22 may able to be rotated integrally with the rotation shaft 21. The wheel 22 may also be supported by the rotation shaft 21 such that the wheel 22 can be displaced in the radial direction of the rotation shaft 21.

In the exemplified embodiment, the wheel 22 may be biased in the direction approaching the driver 15 by the compression spring 29 housed in the insertion hole 28. Because of this configuration, the wheel 22 may return to a position so as to become coaxial with the rotation shaft 21 (which may correspond to a normal engagement position with respect to the driver 15). Accordingly, the displacement allowing mechanism 27 may be made more compact by the compression spring 29 housed in the insertion hole 28.

In the exemplified embodiment, the displacement restricting mechanism 40 may include the compression spring 45 that is biased in the direction in which the lock member 41 retracts from the insertion hole 28. Accordingly, the lock member 41 may reliably retract from the insertion hole by a simple configuration.

In the exemplified embodiment, the cam mechanism 42 may include the plurality of cams C1 C2, and C3 that are disposed at unequal intervals around the axis line of the rotation shaft 21 (which may also correspond to being around the motor axis line J). Because of this configuration, the rotation cam 43 may engage the fixed cam 44 at the predetermined relative position around the axis line of the rotation shaft 21. Accordingly, the advancing/retracting movement of the lock member 41 into/from the insertion hole 28 may be performed at the predetermined position of the rotation cam 43 relative to the fixed cam 44 around the axis line of the rotation shaft 21. In other words, the wheel 22 may be allowed to be displaced in the radial direction of the rotation shaft 21 only when the rotation cam 43 is located at the predetermined position relative to the fixed cam 44 around the axis line of the rotation shaft 21. Accordingly, the engagement state of the lift mechanism 20 with regard to the driver 15 can be properly and reliably retained.

The embodiment discussed above may be modified in various ways. In the above embodiment, the lift mechanism 20 may include the wheel 22 having ten engagement portions P and the driver 15 having ten engaged portions L. However, the numbers of engagement portions P and engaged portions L does not need to be limited to ten. The numbers of the engagement portions P and the engaged portions L may be set according to, for example, a stroke of the driver 15 and/or a size of the tool main body 10, etc.

In the above-described embodiment, the compression spring 29 may be used as the biasing member to bias the wheel 22 in the direction approaching the driver 15. However, other biasing members may be used, such as, for example, a leaf spring or a urethane rubber member, etc. Furthermore, a biasing member to bias the wheel 22 may be located outside the insertion hole 28.

In the above-described embodiment, in order to dispose the three top portions 43*c*, 43*d*, and 43*e* of the rotation cam 43 at unequal intervals in the circumferential direction of the rotation cam 43, each of the portions 43*c*, 43*d*, and 43*e* may have a different length relative to each other in the circumferential direction of the rotation cam 43. Additionally, each starting point of the top portions 43*c*, 43*d*, and 43*e* in the circumferential direction of the rotation cam 43 may be disposed at different intervals relative to each other. However, the top portions may be configured such that each starting point is disposed at an equal interval and that each top portion has a different length relative to each other. Alternatively, the top portions may be configured such that each top portion has the same length as each other and that each starting point is disposed at unequal intervals. In either case, the rotation cam may engage the fixed cam at a predetermined relative portion in the rotation direction of the rotation cam. In the above-described embodiment, the three lift portions 43*f*, 43*g*, and 43*h* of the rotation cam 43 may be configured to have the same length in the circumferential direction (and to have the same tilt angle, thereby enabling the rotation cam to move uniformly) and to be disposed at unequal intervals in the circumferential direction. However, in a case where each starting point of the top portions is disposed at equal intervals and each top portion has a different length relative to each other, the three lift portions may be configured to have the same length and to be disposed at equal intervals in the circumferential direction.

In the exemplified embodiment, the cam mechanism 42 may include the three Cams C1, C2, and C3 positioned around the rotation axis of the rotation shaft 21. However, the number of cams may be two or more than three.

As discussed above, it may be preferable that the wheel 22 is configured to be displaceable in a direction parallel to a direction in which the first engagement portion P1 receives the external force F from the engaged portion L of the driver 15. Because of this configuration, in a case where the movement of the first engagement portion P1 is being interfered with by the engaged portion L, the wheel 22 may be smoothly displaced in a direction away from the engaged portion L. However, it is also possible that a displacement direction of the wheel 22 with regard to the direction of the external force F can be offset appropriately with regard to the motor axis line J.

FIGS. 17 to 26 show a lift mechanism 50 according to a second embodiment of the present disclosure. The lift mechanism 50 may include a displacement allowing mechanism 60 that has substantially the same configuration as in the first embodiment. The lift mechanism 50 of the second embodiment also includes a displacement restricting mechanism 70 that differs from that in the first embodiment. Descriptions of the members and configurations that do not need to be modified and are in common with the first and second embodiments are omitted by use of the same reference numerals.

The lift mechanism 50 according to the second embodiment may include a rotation shaft 51 that is rotated by the electric motor 32. The lift mechanism 50 may also include a wheel 52 that is supported by the rotation shaft 51. The electric motor 32 may rotate the wheel 52 of the lift mechanism 50. The wheel 52 may include two flanges 52*a*, which may be parallel to each other and spaced apart by a predetermined distance. A plurality of engagement portions P may be disposed between the two flanges 52*a* such that each end of the plurality of engagement portions P is supported by a peripheral edge portion of the corresponding flange 22*a*. In the second embodiment, ten engagement portions P (P1 to P10) may be exemplified. Each of the plurality of engagement portions P may be formed to have a cylindrical shape.

Figure 19:
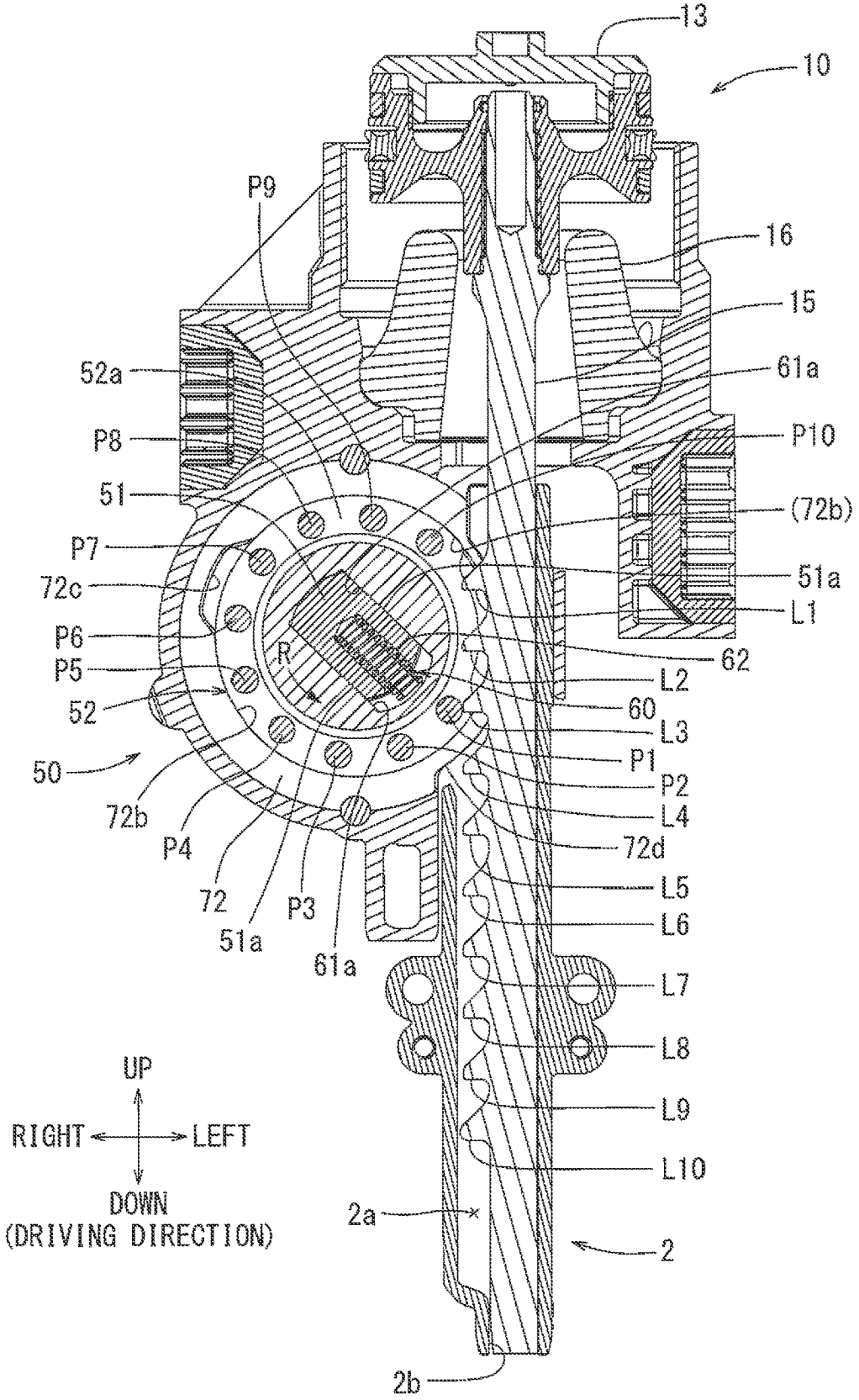
FIG. 19 is a longitudinal sectional view of the lift mechanism according to the second embodiment, showing that the driver is in a locked state in which the driver has stopped at a locked position near the lower end position.

As shown in FIG. 19, ten engaged portion L (L1 to L10) may be arranged at equal intervals along the longitudinal direction (e.g., the up-down direction) of the driver 15 on the right side of the driver 15, in substantially the same manner as in the first embodiment. The driver 15 and the piston 13 may return upwards by rotation of the wheel 52, with each of the engagement portions P of the wheel 52 engaging a corresponding engaged portion L of the driver 15. As indicated by an arrow R in FIGS. 19 and 20, the wheel 52 may rotate in a counterclockwise direction by activation of the electric motor 32.

The lift mechanism 50 according to the second embodiment may include the displacement allowing mechanism 60 for allowing the wheel 52 to be displaced in the radial direction of the rotation shaft 51. The displacement allowing mechanism 60 may include an insertion hole 61 formed in the wheel 52. A pair of slide surfaces 61*a*, which are parallel to each other and extend in a radial direction of the wheel 52, may be formed on an inner wall surface of the insertion hole 61. The insertion hole 61 may be formed in an oblong hole shape extending in the radial direction of wheel 52. The wheel 52 may be allowed to be displaced relative to the rotation shaft 51 in the radial direction of the rotation shaft 51.

Figure 20:
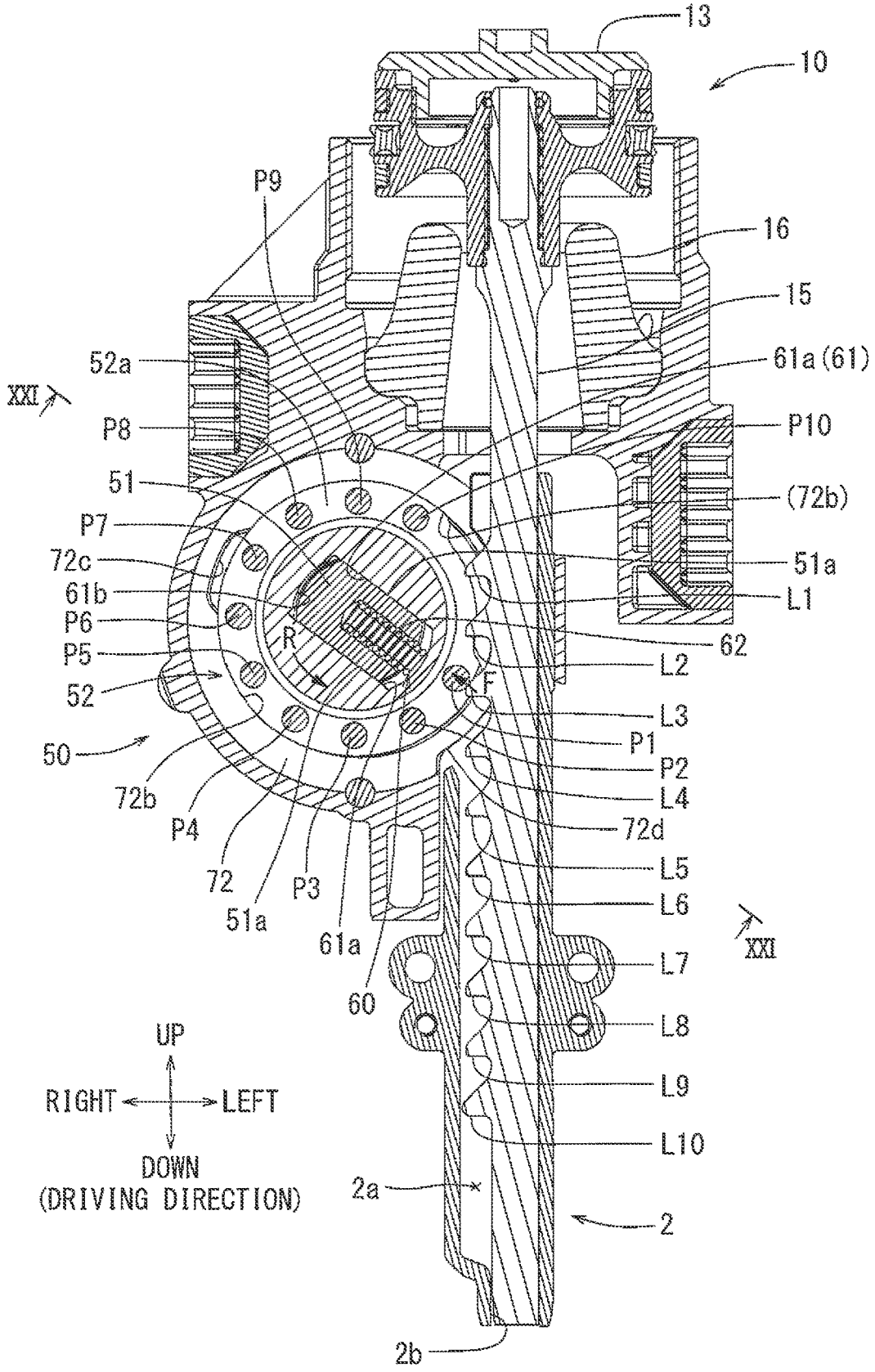
FIG. 20 is a longitudinal sectional view of the lift mechanism according to the second embodiment, showing that the wheel has been displaced in a radial direction of the rotation shaft.
Figure 21:
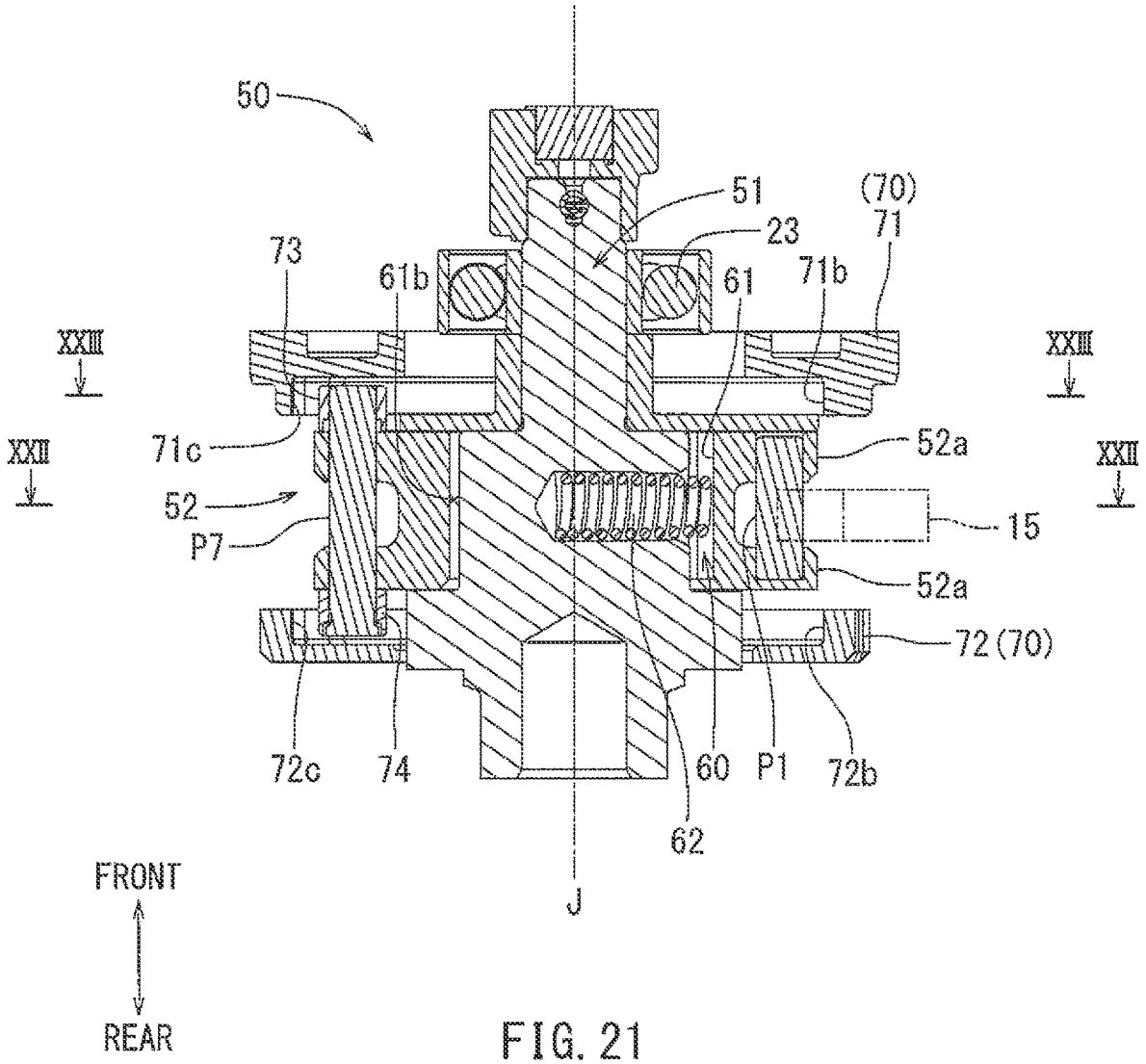
FIG. 21 is a cross-sectional view taken along line XXI-XXI of FIG. 20, showing a lateral sectional view of the lift mechanism.
Figure 22:
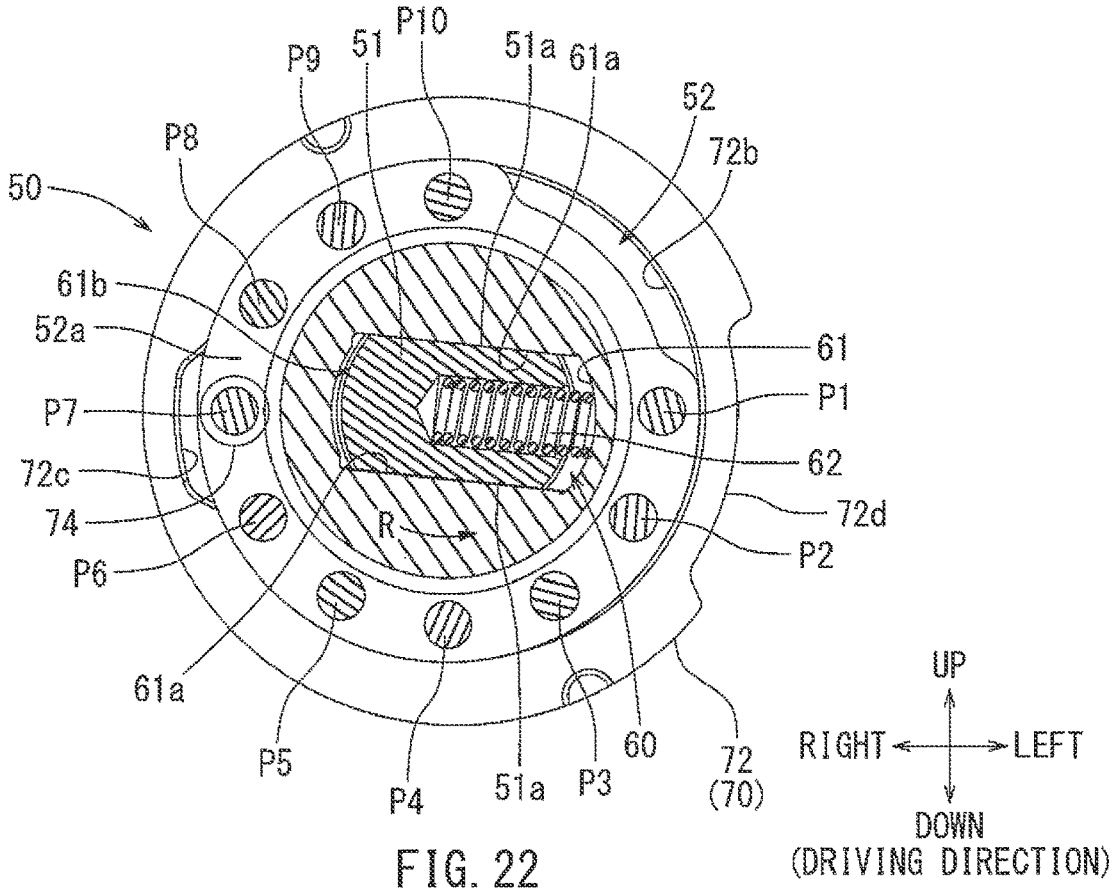
FIG. 22 is a cross-sectional view taken along line XXII-XXII of FIG. 21, showing a longitudinal sectional view of the lift mechanism. This figure shows a state in which the wheel is allowed to be displaced in a radial direction of the wheel.
Figure 23:
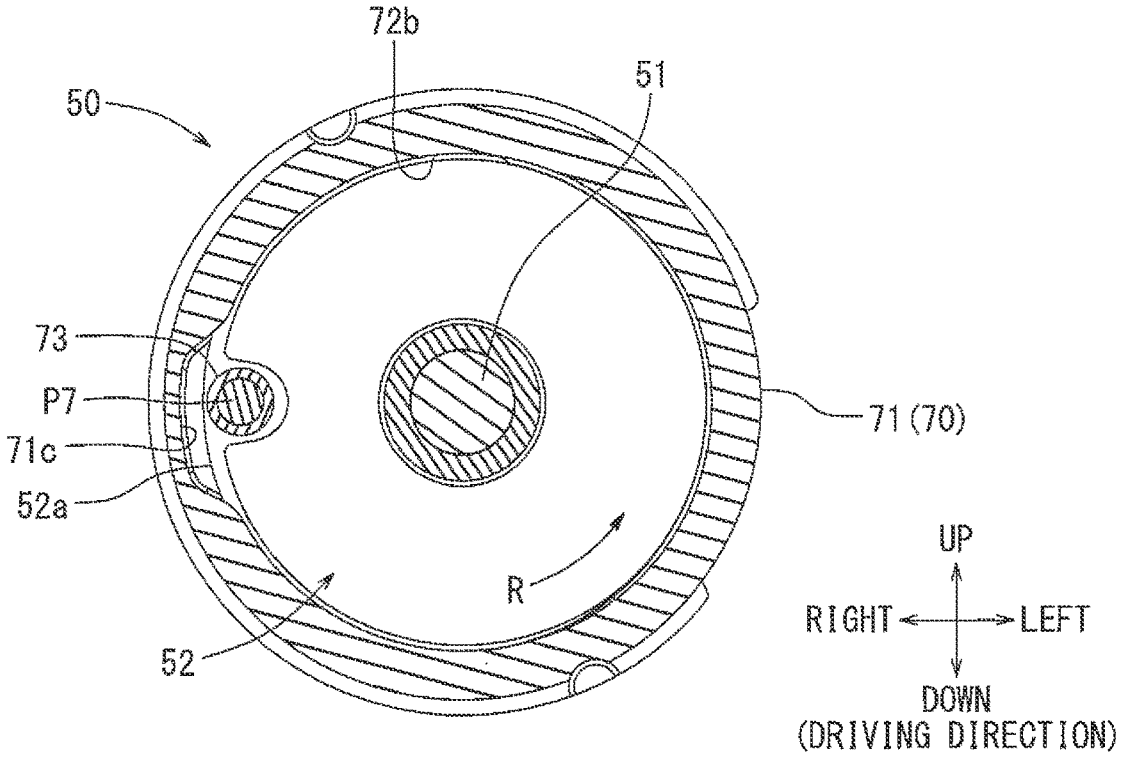
FIG. 23 is a cross-sectional view taken along line of FIG. 21, showing a longitudinal sectional view of the lift mechanism. This figure shows a state in which a restriction member has disengaged from a restriction wall and disposed in a restriction release portion.

The rotation shaft 51 may be inserted into the insertion hole 61. The pair of supporting surfaces 51*a* of the rotation shaft 51 may slidably contact the pair of slide surface 61*a* of the insertion hole 61. Accordingly, the wheel 52 may be supported by the rotation shaft 51 such that the wheel 52 may rotate integrally with the rotation shaft 51. The wheel 52 may also be displaced in the radial direction of the rotation shaft 51 within a fixed range. A displacement of the wheel 52 in the radial direction of the rotation shaft 51 may accommodate for an interference of the movement of the engagement portions P by the engaged portions L of the driver 15. A compression spring 62 may be housed between the inner wall surface of the insertion hole 61 and the rotation shaft 51. Owing to a biasing force of the compression spring 62, the wheel 52 may be biased in a direction in which the engagement portion P approaches the engaged portion L of the driver 15. Because of this configuration, a displacement of the engagement portion P in the radial direction of the rotation shaft 51 away from the engaged portion L may be performed against the biasing force of the compression spring 62. When the wheel 52 is displaced away from the engaged portion L against the compression spring 62, as shown in FIGS. 20-22, a gap 61*b* may appear between the inner surface of the insertion hole 61 and an outer surface of the rotation shaft 61 on a side of the rotation shaft 61 opposite to the compression spring 62. The gap 61*b* may correspond to a displacing length of the wheel 52.

Figure 17:
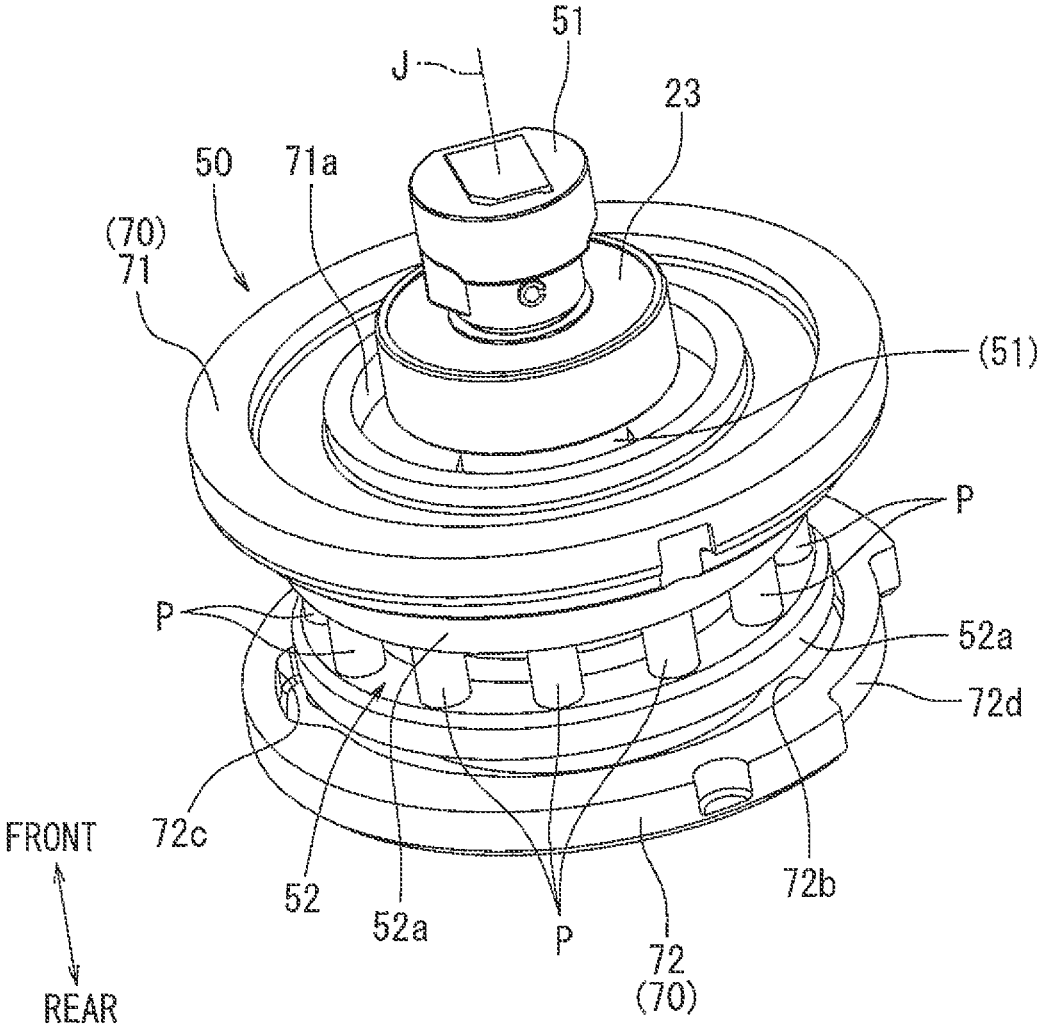
FIG. 17 is a perspective view of a lift mechanism according to a second embodiment of the present disclosure.
Figure 18:
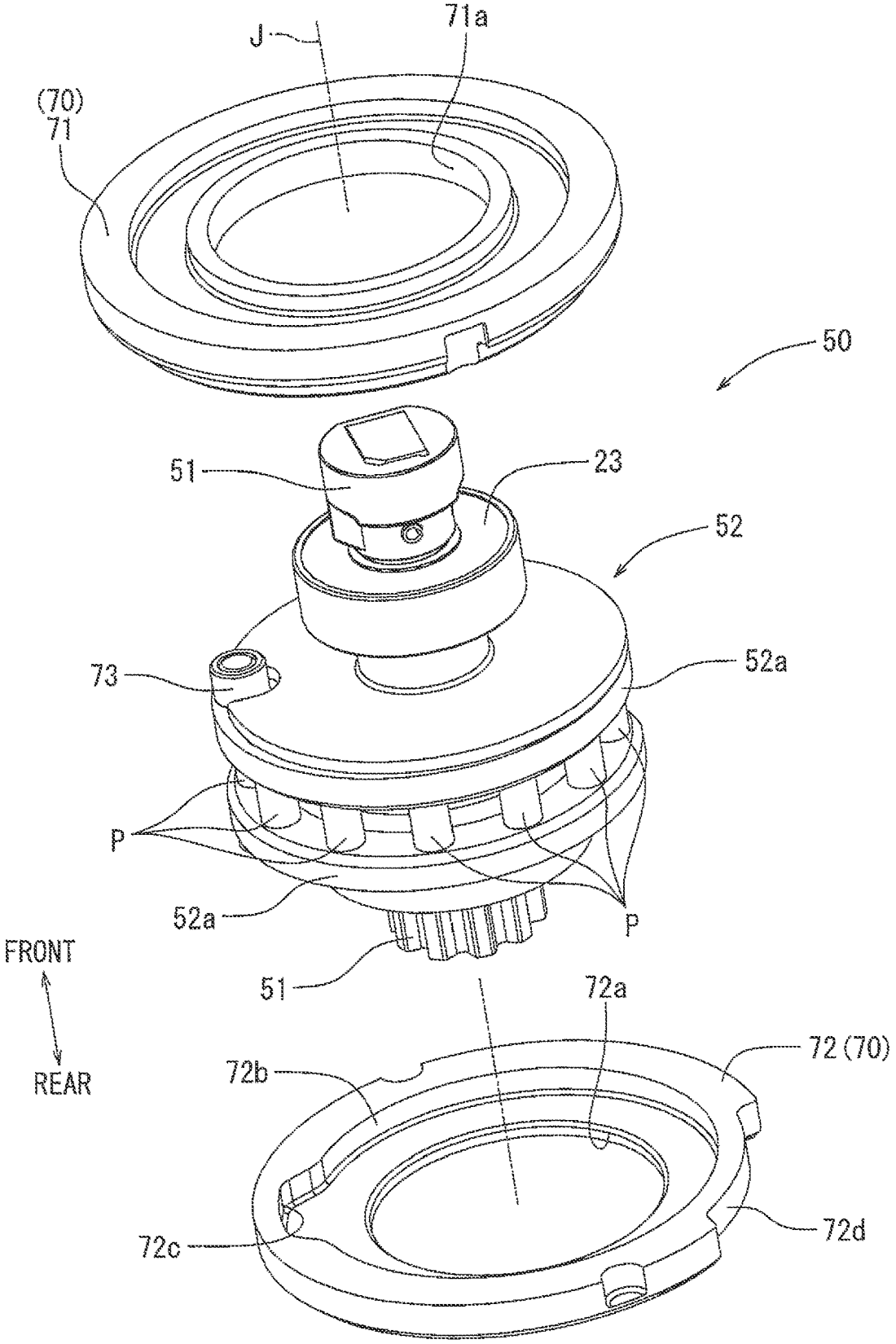
FIG. 18 is an exploded perspective view of the lift mechanism according to the second embodiment.

The lift mechanism 50 according to the second embodiment may include a displacement restricting mechanism 70 that restricts the wheel 52 from being displaced in the radial direction of the rotation shaft 51. As shown in, for example, FIGS. 17 and 21, the displacement restricting mechanism 70 may include restriction disks 71, 72 and restriction members 73, 74. As shown in FIGS. 17 and 18, the restriction disc 71 may be disposed on a front side of the wheel 52 and the restriction disc 72 may be disposed on a rear side of the wheel 52. The restriction discs 71, 72 may be formed in a circular shape with approximately the same diameter and may be coaxially disposed parallel to each other. The restriction discs 71, 72 may be fixed to the lift mechanism case 25. Accordingly, the restriction discs 71, 72 may not rotate by the activation of the electric motor 32. An insertion hole 71*a* may be formed in the center of the restriction disc 71. Similarly, an insertion hole 72*a* may be formed in the center of the restriction disc 72. The rotation shaft 51 may be inserted into the insertion holes 71*a*, 72*a* so as to be rotatable relative to the restriction discs 71, 71. As clearly shown in FIG. 17, an arc-shaped cut 72*d* may be formed over a certain outer periphery of the rear-side restriction disc 72. The arc-shaped cut 72*d* may help assemble the magazine 6 with respect to driving nose 2.

As shown in FIG. 18, a restriction wall 72*b* may be formed in the rear-side restriction disc 72. Similarly, a restriction wall 71*b* may be formed in the front-side restriction disc 71. The restriction wall 71*b* of the front-side restriction disc 71 and the restriction wall 72*b* of the rear-side restriction disc 72 may be formed symmetrically in the front-rear direction. In the second embodiment, the restriction wall 72*b* of the rear-side restriction disc 72 may be formed on an outer peripheral surface of a groove formed in the rear-side restriction disc 72. Similarly, the restriction wall 71*b* of the front-side restriction disc 71 may be formed on an outer peripheral surface of a groove formed in the front-side restriction disc 71. Furthermore, a restriction release portion 72*c* may be formed within a predetermined portion in the restriction wall 72*b* of the rear-side restriction disc 72. Similarly, a restriction release portion 71*c* may be formed within a predetermined portion in the restriction wall 71*b*. In the second embodiment, the restriction release portions 71*c*, 72*c* may be recessed toward the outside.

The front-side restriction release portion 71*c* and the rear-side restriction release portion 72*c* may be arranged at the same relative position around the rotation shaft 51 (which may also correspond to the motor axis line J) and arranged facing to each other. The two restriction release portions 71*c*, 72*c* may be positioned on a side of the rotation shaft 51 opposite to the driver 15. Furthermore, the two restriction release portions 71*c*, 72*c* may be positioned within a certain angle range (for example, approximately 40 degrees) around the rotational shaft 51 (and accordingly the motor axis line J) from the driver 15. In the second embodiment, the angle range of the restriction release portions 71*c*, 72*c* may correspond to an angle between adjacent two engagement portions P (in FIGS. 19, 20, the sixth and seventh engagement portions P6, P7). However, the angle range may increase as desired, up to approximately 60 degrees.

As shown in FIG. 21, the restriction members 73, 74 may be formed by use of the engagement portion P of the wheel 52. In the second embodiment, the restriction members 73, 74 may be formed by use of the seventh engagement portion P7. A front end of the seventh engagement portion P7 may protrude frontwards from the front flange 52*a*. A rear end of the seventh engagement portion P7 may protrude rearwards from the rear flange 52*a*. A roller may be rotatably supported by each of the protruding portions of the seventh engagement portion P7. The front and rear rollers may be the restriction members 73, 74, respectively.

Figure 25:
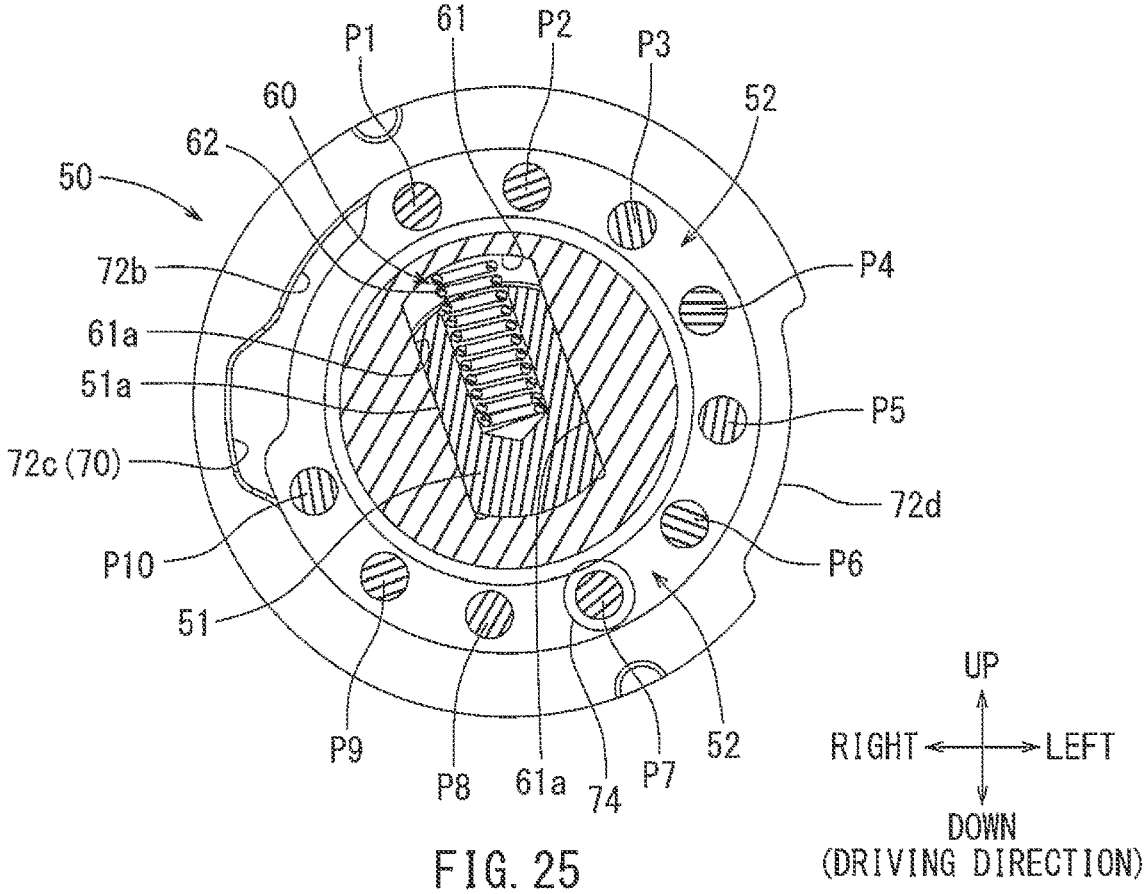
FIG. 25 is a longitudinal sectional view of the lift mechanism of the second embodiment, showing a state in which the wheel is restricted from being displaced in the radial direction of the rotation shaft.
Figure 26:
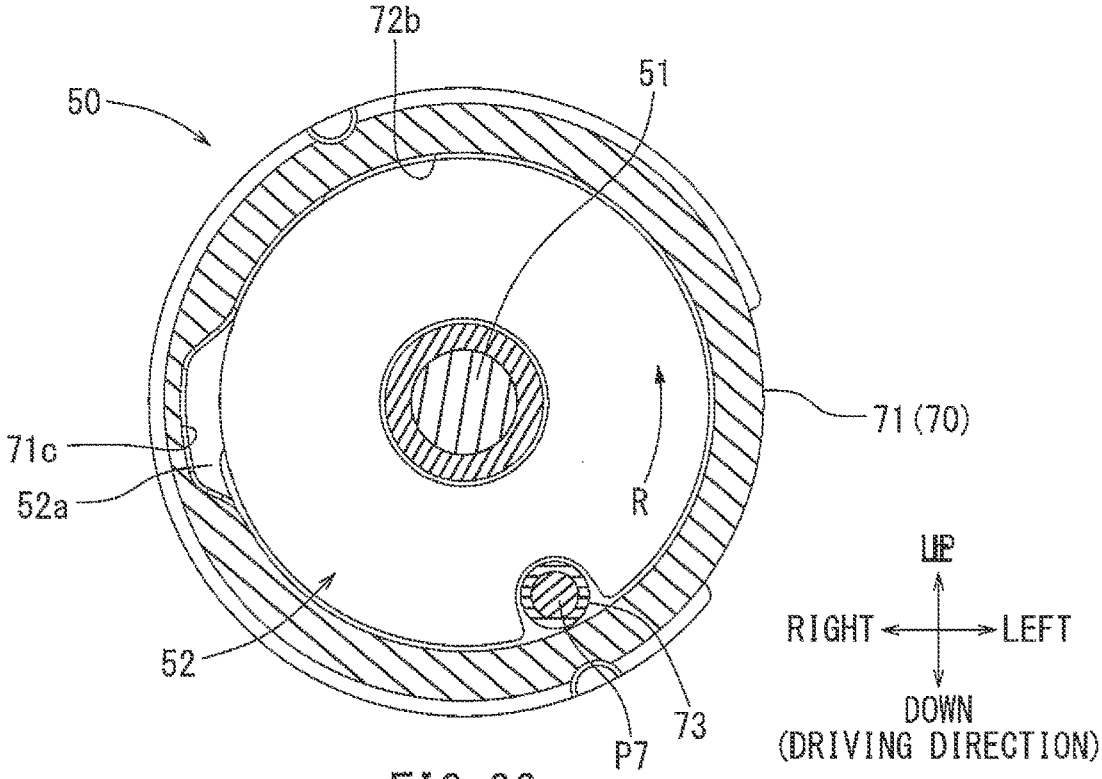
FIG. 26 is a longitudinal sectional view of the lift mechanism of the second embodiment, showing that the restriction member moves along the restriction wall.

When the wheel 52 rotates, the restriction members 73, 74 may move along the restriction walls 71*b*, 72*b*. While the restriction members 73, 74 move along the restriction walls 71*b*, 72*b*, the wheel 52 may be restricted from being displaced in the radial direction of the rotation shaft 51. Accordingly, as shown in FIGS. 25 and 26, the wheel 52 may rotate in the direction indicated by the arrow R around the rotation shaft 51 (which may also be the motor axis line J).

When the wheel 52 rotates in the direction indicated by the arrow R, the first engagement portion P1 may enter the driving passage 2*a* to engage the engaged portion L of the driver 15. When the wheel 52 rotates to be disposed at a position shown in FIGS. 22, 23, the restriction members 73, 74, which is supported by the seventh engagement portion P7, which is opposite to the first engagement portion P1, may disengage the restriction walls 71*b*, 72*b* and reach the restriction release portions 71*c*, 72*c*. When the restriction members 73, 74 reaches the restriction release portions 71*c*, 72*c*, the restriction members 73, 74 may be displaceable in an outside direction (e.g., being insertable into the restriction release portions 71*c*, 72*c*). Because of this configuration, the wheel 52 may be in a restriction release state, in which the wheel 52 can be displaced in a direction away from the driver 15 and against the compression spring 62.

In a similar manner as in the first embodiment, when a large external force F is applied to the wheel 52 of the second embodiment through the first engagement portion P1, owing to disengagement of the first engagement portion P1 from the engaged portion L, which may be caused by nail jamming, etc., an entirety of the wheel 52 may be displaced in the radial direction of the rotation shaft 51, as shown in FIGS. 20-22. Accordingly, the gap 61*b* may appear between the rotation shaft 51 and the insertion hole 61. Because of this configuration, interference of the further movement of the first engagement portion P1 by the third engaged portion L3 may be accommodated for.

Figure 24:
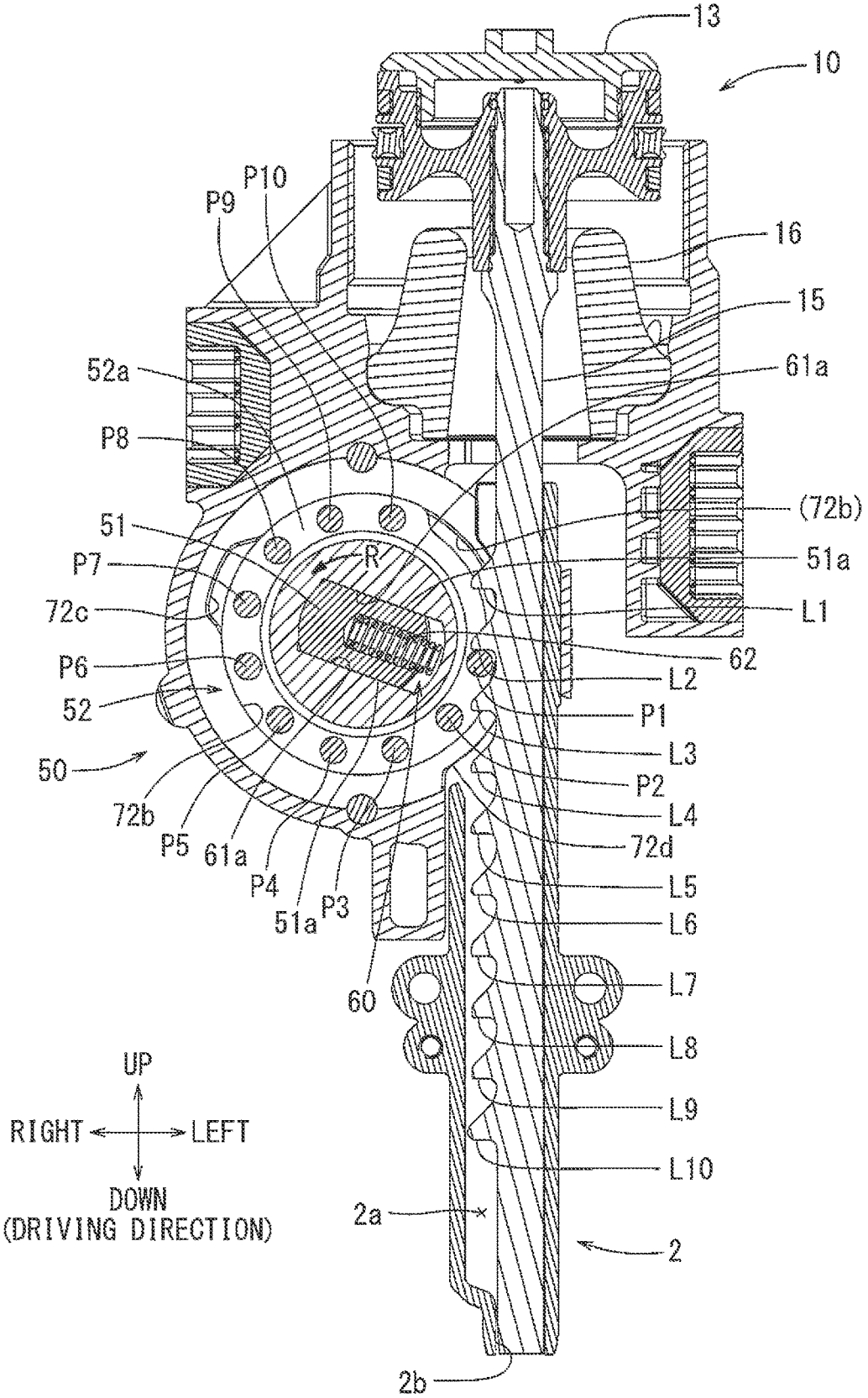
FIG. 24 is a longitudinal sectional view of the lift mechanism of the second embodiment, showing a state in which the first engagement portion has engaged the second engaged portion.

While the wheel 52 is displaced in the direction away from the driver 15 and while it rotates in the direction indicated by the arrow R, the first engagement portion P1 may pass over a lateral side of the third engaged portion L3. At this stage, the external force F which the first engagement portion P1 receives from the third engaged portion L3 may decrease. Accordingly, as shown in FIG. 24, the wheel 22 may return in a direction approaching the driver 15, owing to the biasing force of the compression spring 62. This movement of the wheel 52 may cause the first engagement portion P1 to contact a lower surface of the second engaged portion L2. Then, the restriction members 73, 74 may move away from the restriction release portions 71*c*, 72*c* so that they may then move along the restriction walls 71*b*, 72*b*. Thereby, the displacement of the wheel 52 in the radial direction of the rotation shaft 51 is restricted.

By further rotation of the wheel 52 after the first engagement portion P1 engages the lower surface of an engaged portion L (e.g., properly engages an engaged portion L, for example without being in the interference state), the driver 15 may move upwards from a position in which the driver 15 was previously stopped. When the restriction members 73, 74 moves along the restriction walls 71*b*, 72*b*, as shown in FIGS. 25 and 26, the wheel 52 may be restricted from being displaced in the radial direction of the rotation shaft 51. Accordingly, the driver 15 may return upwards to the standby position.

By using the restriction allowing mechanism 60 in the second embodiment, the displacement of the wheel 52 in the radial direction of the rotation shaft 51 may be allowed within a predetermined range, which may correspond to where the first engagement portion P1 is to engage an engaged portion L. When any of the second engagement portion to the last engagement portion (P2 to P10) engages the engaged portion L of the driver 15, the displacement of the wheel 52 in the radial direction of the rotation shaft 51 may be restricted by the displacement restricting mechanism 70.

A timing for when the wheel 52 is displaceable in the radial direction of the rotation shaft 51 by the displacement allowing mechanism 60 may be modified as required. In the exemplified embodiment, the restriction members 73, 74 may be formed at the position of the seventh engagement portion P7. However, the restriction members 73, 74 may be formed at another position on a forward side or on a rear side in the rotation direction of the wheel 52. Furthermore, the position of the restriction release portions 71*c*, 72*c* around the rotation shaft 51 (and accordingly around the motor axis line J) may be modified to another position on a forward side or on a rear side in the rotation direction of the wheel 52. Furthermore, as discussed above, the angle range over which the restriction release portions 71*c*, 72*c* extend may be increased or decreased from the exemplified 40 degrees.

In the second embodiment, a timing for when a state in which the wheel 52 is allowed to be displaced in the radial direction of the rotation shaft 51 is changed to a state in which the wheel 52 is restricted from being displaced may be set when the first engagement portion P1 engages the engaged portion L of the driver 15 (for instance, when it properly engages without being in the interference state), which is a similar manner as in the first embodiment. Alternatively, any desirable timing may be adopted. For example, it may be configured such that when the second engagement portion P2 engages an engaged portion L, the restriction members 73, 74 moves away from the restriction release portions 71*c*, 72*c* to cause the wheel 52 to be restricted from being displaced in the radial direction of the rotation shaft 52.

In the second embodiment, the cam mechanism 42 of the first embodiment may not need to be used. Accordingly, the lift mechanism 50 in the second embodiment may be simple and made more compact in the direction along the rotation shaft 51 (which may also correspond to the direction of the motor axis line J).

Further modifications can be made in the second embodiment. In the second embodiment, two restriction members 73, 74 may be formed in the wheel 52. However, for example, either one of the two restriction members 73, 74 can be omitted.

Furthermore, in the second embodiment, the restriction members 73, 74 may be formed by use of one engagement portion P (the seventh engagement portion P7). However, for example, a restriction member can be newly formed without using an engagement portion P.

Furthermore, in the second embodiment, the restriction walls 71*b*, 72*b* may be formed on the outer peripheral surfaces of the groove formed in the restriction discs 71, 72. However, an annular protruding wall that protrudes from a rear side of the disc 71 may be formed and another annular protruding wall that protrudes from a front side of the disc 72 may be formed, such that the two protruding walls face each other to serve as the restriction wall.

The driving tool 1 in the first and second embodiments may be one example of the driving tool according to one aspect of the present disclosure. The piston 13 in the first and second embodiments may be one example of a piston according to one aspect of the present disclosure. The driver 15 in the first and second embodiments may be one example of a driver according to one aspect of the present disclosure. The engaged portions L (L1 to L10) in the first and second embodiments may be one example of a plurality of engaged portions according to one aspect of the present disclosure.

The lift mechanism 20 in the first embodiment and the lift mechanism 50 in the second embodiment may be one example of a lift mechanism according to one aspect of the present disclosure. The rotation shaft 21 in the first embodiment and the rotation shaft 51 in the second embodiment may be one example of a rotation shaft according to one aspect of the present disclosure. The wheel 22 in the first embodiment and the wheel 52 in the second embodiment may be one example of a wheel according to one aspect of the present disclosure. The engagement portions P (P1 to P10) in the first and second embodiments may be one example of engagement portions according to one aspect of the present disclosure.

The displacement allowing mechanism 27 in the first embodiment and the displacement allowing mechanism 60 in the second embodiment may be one example of a displacement allowing mechanism according to one aspect of the present disclosure. The displacement restricting mechanism 40 in the first embodiment and the displacement restricting mechanism 70 in the second embodiment may be one example of a displacement restricting mechanism according to one aspect of the present disclosure. The first engagement portion P1 in the first and second embodiments may be one example of a first engagement portion according to one aspect of the present disclosure. The second engagement portion P2 in the first and second embodiments may be one example of a second engagement portion according to one aspect of the present disclosure.

What is claimed is:

1. A driving tool, comprising:

a piston configured to move in a driving direction by a pressure of a gas;

a driver configured to drive a driving member by moving with the piston in the driving direction; and a lift mechanism configured to move the driver in a direction opposite to the driving direction, wherein:

the driver comprises a plurality of engaged portions spaced in a longitudinal direction of the driver;

the lift mechanism comprises:

a rotation shaft;

a wheel configured to rotate integrally with and around the rotation shaft;

a plurality of engagement portions spaced along an outer periphery of the wheel, each of the plurality of engagement portions being configured to engage a corresponding engaged portion;

a displacement allowing mechanism configured to allow the wheel to be displaced in a radial direction of the rotation shaft; and a displacement restricting mechanism configured to restrict the wheel from being displaced in the radial direction of the rotation shaft;

the plurality of engagement portions includes a first engagement portion that is configured to firstly engage one of the plurality of engaged portions when the lift mechanism is to move the driver in the direction opposite to the driving direction;

the driver and the lift mechanism are configured such that, when the first engagement portion engages one of the plurality of engaged portions, the wheel is released from a restriction state in which the wheel is restricted from being displaced in the radial direction of the rotation shaft by the displacement restricting mechanism;

the displacement allowing mechanism includes an insertion hole in the wheel, the insertion hole having an oblong hole shape extending in the radial direction of the wheel such that the wheel is allowed to be displaced in the radial direction of the rotation shaft; and the displacement restricting mechanism includes a lock member that is configured to restrict the wheel from being displaced in the radial direction of the rotation shaft by insertion of the lock member into the insertion hole.

2. The driving tool according to claim 1, wherein:

the plurality of engagement portions includes a second engagement portion that is configured to secondly engage a second of the plurality of engaged portion when the lift mechanism moves the driver in the direction opposite the driving direction after the first engagement portion engages the one of the plurality of engaged portions; and the driver and the lift mechanism are configured such that, when the second engagement portion engages the second of the plurality of engaged portions, the wheel is returned to the restriction state.

3. The driving tool according to claim 1, wherein the displacement restricting mechanism is configured such that the wheel is not displaceable in a direction parallel to the driving direction when the restriction state is released.

4. The driving tool according to claim 1, wherein the lock member advances into the insertion hole and retracts from the insertion hole in an axial direction of the rotation shaft.

5. The driving tool according to claim 1, wherein the lock member is on an inner periphery side of the plurality of engagement portions in the radial direction of the rotation shaft.

6. The driving tool according to claim 1, wherein the displacement restricting mechanism includes a cam mechanism by which the lock member advances into the insertion hole and retracts from the insertion hole according to rotation of the wheel.

7. The driving tool according to claim 1, wherein:

the insertion hole includes a pair of slide surfaces on an inner wall surface of the insertion hole;

the pair of slide surfaces are parallel to each other and extend in a radial direction of the wheel;

the rotation shaft includes a pair of supporting surfaces extending in the radial direction of the rotation shaft and extending on an outer peripheral surface of the rotation shaft; and each of the pair of supporting surfaces is configured to face a corresponding slide surface.

8. The driving tool according to claim 1, wherein:

a biasing member is in the insertion hole; and the biasing member is configured to bias the wheel in a direction parallel to the radial direction of the rotation shaft.

9. The driving tool according to claim 8, wherein the direction in which the biasing member is configured to bias the wheel is a direction in which the first engagement portion is configured to engage one of the plurality of engaged portions.

10. The driving tool according to claim 1 wherein the displacement restricting mechanism includes a biasing member configured to bias the lock member in a direction to retract from the insertion hole.

11. The driving tool according to claim 6, wherein:

the cam mechanism includes a plurality of cams spaced at unequal intervals around an axis of the rotation shaft; and the lock member completely retracts from the insertion hole when the plurality of cams engages each other at a predetermined position around the axis of the rotation shaft.

12. The driving tool according to claim 1, wherein the first engagement portion is further configured to firstly engage one of the plurality of engaged portions after the piston has moved in the driving direction.

13. A driving tool, comprising:

a piston configured to move in a driving direction by a pressure of a gas;

a driver configured to drive a driving member by moving with the piston in the driving direction; and a lift mechanism configured to move the driver in a direction opposite to the driving direction, wherein:

the driver comprises a plurality of engaged portions spaced in a longitudinal direction of the driver;

the lift mechanism comprises:

a rotation shaft;

a wheel configured to rotate integrally with and around the rotation shaft;

a plurality of engagement portions spaced along an outer periphery of the wheel, each of the plurality of engagement portions being configured to engage one of the plurality of engaged portions;

a displacement allowing mechanism configured to allow the wheel to be displaced in a radial direction of the rotation shaft; and a displacement restricting mechanism configured to restrict the wheel from being displaced in the radial direction of the rotation shaft;

the plurality of engagement portions includes a first engagement portion that is configured to firstly engage a first of the plurality of engaged portions when the lift mechanism is to move the driver in the direction opposite to the driving direction;

the driver and the lift mechanism are configured such that, when the first engagement portion engages the first of the plurality of engaged portions, the wheel is released from a restriction state in which the wheel is restricted from being displaced in the radial direction of the rotation shaft by the displacement restricting mechanism;

the displacement allowing mechanism includes an insertion hole in the wheel, the insertion hole having an oblong hole shape in a radial direction of the wheel such that the wheel is allowed to be displaced in the radial direction of the rotation shaft; and the displacement restricting mechanism comprises:

a restriction member in the wheel;

a restriction wall (i) facing a periphery of the wheel, (ii) having a shape matching the periphery of the wheel and (iii) configured to restrict the restriction member from being displaced in the radial direction of the rotation shaft; and a restriction release portion that (i) releases the restriction state of the restriction member caused by the restriction wall and (ii) is recessed outwardly from the restriction wall along the periphery of the wheel.

14. The driving tool according to claim 13, wherein the restriction member protrudes from a surface of the wheel in an axial direction of the wheel.

15. The driving tool according to claim 14, wherein:

an end portion of one of the plurality of engagement portions protrudes from the surface of the wheel; and the restriction member is the end portion of the one of the plurality of engagement portions.

16. The driving tool according to claim 15, wherein the restriction member is opposite to the first engagement portion with regard to the rotation shaft.

17. The driving tool according to claim 13, wherein the restriction member includes a rotatable roller rotatable around an axis of the restriction member.

18. The driving tool according to claim 13, wherein the wheel includes at least one restriction disc that includes the restriction wall and the restriction release portion.

19. The driving tool according to claim 18, wherein the restriction release portion has a predetermined angle range around the rotation shaft.

20. The driving tool according to claim 19, wherein the wheel includes two restriction discs spaced apart along an axial direction of the rotation shaft.

* * * * *